US005088467A

United States Patent [19]

Mesenich

[11] Patent Number: 5,088,467

[45] Date of Patent: Feb. 18, 1992

[54] ELECTROMAGNETIC INJECTION VALVE

[75] Inventor: Gerhard Mesenich, Bochum, Fed. Rep. of Germany

[73] Assignee: Coltec Industries Inc, New York, N.Y.

[21] Appl. No.: 613,364

[22] Filed: Nov. 15, 1990

Related U.S. Application Data

[60] Division of Ser. No. 120,638, Nov. 13, 1987, Pat. No. 4,984,549, which is a continuation of Ser. No. 706,162, Feb. 28, 1985, abandoned.

[51] Int. Cl.[5] ..... F02M 23/00

[52] U.S. Cl. ..... 123/531; 123/556

[58] Field of Search ..... 123/531, 532, 533, 557, 123/556, 585, 472; 239/585

[56] References Cited

U.S. PATENT DOCUMENTS

| | | | |
|---|---|---|---|
| 2,203,669 | 6/1940 | Butler | 123/532 |
| 2,220,558 | 11/1940 | Van Dijck et al. | 123/198 |
| 3,980,056 | 9/1976 | Kraus | 123/556 |
| 4,006,719 | 2/1977 | Kanada | 123/531 |
| 4,157,084 | 6/1979 | Wallis | 123/532 |
| 4,197,996 | 4/1980 | Giardini | 123/422 |
| 4,216,753 | 8/1980 | Inoue | 123/531 |
| 4,401,059 | 8/1983 | Goodman et al. | 123/25 L |
| 4,406,255 | 9/1983 | Goodman | 123/25 J |
| 4,406,404 | 9/1983 | Horino | 123/532 |
| 4,429,674 | 2/1984 | Lubbing | 123/585 |
| 4,434,765 | 3/1984 | Eshelman | 123/472 |
| 4,459,943 | 7/1984 | Goodman | 123/25 J |
| 4,465,050 | 8/1984 | Igashira | 123/533 |
| 4,508,091 | 4/1985 | Wakeman | 123/472 |
| 4,627,405 | 12/1986 | Imhof | 123/556 |
| 4,708,117 | 11/1987 | Mesenick | 123/533 |

FOREIGN PATENT DOCUMENTS

| | | |
|---|---|---|
| 0007724 | 2/1980 | European Pat. Off. . |
| 0054107 | 6/1982 | European Pat. Off. . |
| 2927440 | 1/1980 | Fed. Rep. of Germany . |
| 2949393 | 6/1980 | Fed. Rep. of Germany . |
| 2914966 | 10/1980 | Fed. Rep. of Germany . |
| 3024424 | 1/1982 | Fed. Rep. of Germany . |
| 971274 | 1/1951 | France . |
| 683017 | 11/1952 | United Kingdom . |
| 1459598 | 12/1976 | United Kingdom . |
| 2054037 | 2/1981 | United Kingdom . |
| 2093121 | 8/1982 | United Kingdom . |

*Primary Examiner*—Carl Stuart Miller
*Attorney, Agent, or Firm*—Howard S. Reiter

[57] ABSTRACT

An electromagnetic valve assembly is shown having an armature and armature-actuated valve member the mass of which is substantially less than the armature and which is not fixedly connected to the armature; upon electrical energization the armature first overcomes a restraining force and then travels a major part of its stroke before actuating the valve member, at a relatively high speed thereby causing movement of the valve member by kinetic energy of the armature.

22 Claims, 9 Drawing Sheets

F
F mech
F mag
F3
F
I0
S
S1
S2
S3

|V|
ΔV1
ΔV2
0
0
S
S1
S2
S3

S
S3
S2
S1
0
0
t
t1
t2
t3
t4
tA

Fig 4a
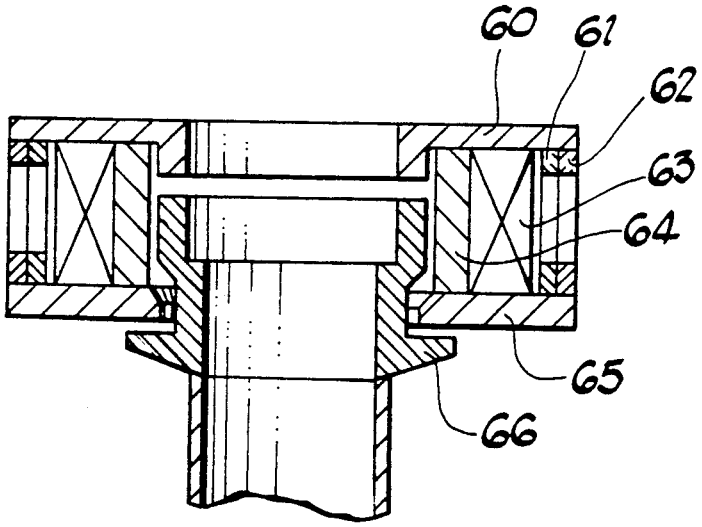
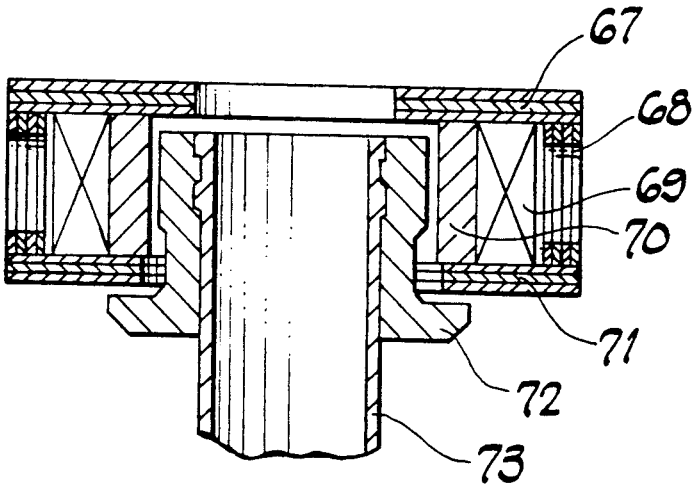
Fig 4b
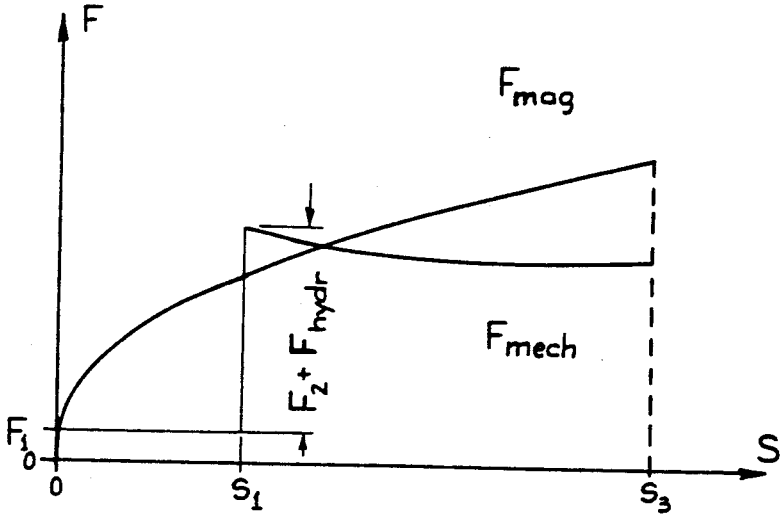
Fig 6

ELECTROMAGNETIC INJECTION VALVE

RELATED APPLICATION

This application is a division of my copending application Ser. No. 120,638 filed Nov. 13, 1987, now U.S. Pat. No. 4,984,549 which, in turn, is a continuation of my copending application Ser. No. 706,162 filed Feb. 28, 1985, for "Electromagnetic Injection Valve" now abandoned.

FIELD OF THE INVENTION

This invention relates generally to electromagnetic injection valves and more particularly to electromagnetic injection valves for the injection of fuel into internal combustion engines. The invention may be practiced where, for example, the injection of fuel is to be made directly into the engine combustion chamber with pressures even in excess of 1000 bars (15,000.00 p.s.i.) or, for example, injection at low pressures as into the induction passage means of an internal combustion engine.

BACKGROUND OF THE INVENTION AND PRIOR ART STATEMENT

In diesel engine applications, it is not uncommon to attempt to attain very high fuel injection pressures even exceeding 1000 bars in order to improve fuel dispersion and to reduce the formation of exhaust emission pollutants. Generally, in such situations a characteristically steep injection curve at the beginning of the injection and a sharply delimited injection end are stipulated. Further, the start and duration of the injection must be adapted to the conditions of the engine performance characteristics. Generally, such adaptation to the engine characteristics is easily accomplished with the employment of associated electronic controls.

Heretofore, purely mechanical injection systems were almost exclusively employed for high pressure injection. Such injection systems always consist of a pump element or system, the injection nozzle and the fluid conduit means interconnecting the pump element and the nozzle. During and after the injection process, strong pressure waves are reflected between the pump and nozzle and the magnitude of such pressure waves may be as much as several-hundred bars. At the pressure waves, in particular after the injection nozzle has closed, zero line contacts may occur at which the vapor pressure of the fuel is fallen short of and this leads to cavitation at the elements of the injection system and to cavity formation with strong shock-like stresses.

In order to obtain a rapid pressure reduction toward the end of the injection, pressure valves at the injection pump are usually provided with relief pistons which increase the volume available to the fuel in the line by the displacement volume. However, it is not always possible to sufficiently reduce the amplitude of the pressure wave reflected during closing with the result that then the reflected pressure wave triggers a new opening process of the nozzle needle valve. It is then that the feared secondary spraying, delayed by the transit time of the pressure wave, occurs resulting in the sprayed fuel being insufficiently atomized and therefore does not completely participate in the combustion.

In injection pumps, the pumping process is fixedly coupled as to a specific angle of engine crankshaft rotation. This results in a high shock-like mechanical load on the injection pump, as the entire pressure buildup takes place within a small angle of rotation in a very short time. As the time for traversing this angle becomes shorter with increasing engine speed, whereas the cross-section of the nozzle holes remain constant, the injection pressure should really increase quadratically with the speed. Fortunately, however, this sharp pressure rise is in large part absorbed by the elasticity of the fuel and of the fuel line or conduit.

Nevertheless, this speed-dependent or related pressure rise leads to considerable problems in the fuel processing or metering. For example, at low speeds the pressure is usually not sufficient to lift the nozzle needle valve completely and because of fuel accumulation or storage in the pressure chamber of the nozzle the pressure rise at the beginning of the injection is further diminished. With the needle valve partially open, the predominant part of the fuel pressure in the valve seat is then transformed into velocity and subsequently swirled in the blind hole of the nozzle. Because of such velocity transformation only a slight fuel pressure is available in front of the nozzle holes, so that a very deficient atomization results. These problems can, of course, be reduced with pintle-type nozzles. Additional secondary spraying occurs also due to the always existing needle valve chatter or bounce when the needle valve sets down in the needle seat.

The strong speed-dependent or related pressure differences make it difficult to adapt the injection nozzle to the requirements of the engine, so that optimum conditions are generally obtained only in narrowly limited engine speed and load ranges.

Furthermore, transit time delays in the fuel lines occur, due to the transport of the pump energy through pressure waves and such makes it difficult to adapt the moment of injection to the requirements of the engine characteristics. In the case of large engines, these problems are no longer controllable because of the relatively long fuel lines. Here, therefore, complicated pump nozzles are required where the pump and nozzle form a unit which is disposed directly in the cylinder head.

For better adaptation of the usual mechanical injection systems to the requirements of the engine characteristics, indirect electronic control of the injection quantity and injection moment is pursued as generally disclosed in Federal Republic of Germany publication DE OS 3024424 A 1. At the individual nozzles, inductive pickups are applied to determine injection start and injection duration. The signals of the inductive pickups and additional operational parameters of the engine are received by an electronic control unit, which in conjunction with a servo magnet adjusts the conventional mechanical injection pump. The injection process, however, which is deficient in broad ranges, cannot be influenced with such a system.

To circumvent the problems resulting from the pressure wave transport of the fuel and which cause most of the difficulties in the usual mechanical injection systems, injection valves may be used where the valve needle is electromagnetically actuated directly. In such an arrangement the pressure chamber of the injection valve is pressurized with a constant fuel pressure so that much smaller pressure fluctuations result upon actuation of the valve and have little influence on the stroke of the needle and valve. There are, however, enormous difficulties in designing sufficiently rapid electromagnets which are able to overcome the high hydraulic forces acting on the valve needle and to do so at an acceptable energy cost.

Because of the major problems with direct electromagnetic actuation of the valve needle, precontrolled systems have been proposed as generally disclosed in Federal Republic of Germany publications DE OS 2914966 and DE OS 2927440. In such arrangements the injection nozzle is provided with an additional injection piston, which is located directly in the nozzle and is actuated through a hydraulic transmission at a relatively low pressure of about 100–300 bar. Because of the hydraulic transmission, the required volume flow in the fuel inlet line is increased by the factor of the transmission ratio. The fuel is drawn from the inlet line intermittently. The intermittent inflow, in turn, causes pressure oscillations the amplitude of which depends almost exclusively on the inflow speed of the fuel. Therefore, the amplitude of the pressure oscillations is increased as compared with a directly operated injection valve at equal fuel line cross-section by the factor of the transmission ratio and, at the same time, because of the lower system pressure, the relative amplitude likewise increases by the factor of the transmission ratio. At equal fuel line cross-section and a normal transmission ratio of about 5, therefore, the amplitude of the pressure oscillations referred to the system pressure is increased by a factor of 25. These pressure oscillations can be absorbed only in part with accumulators disposed directly in the valve. But the main disadvantage compared with directly controlled injection valves is the high additional cost of construction.

An injection valve with directly actuated valve needle is disclosed in Federal Republic of Germany publication DE OS 2949393. There the electromagnet has a helical armature with several simultaneously excited magnet coils. To reduce chatter, the magnet has two braced telescoped cone elements in which the kinetic energy is consumed toward the end of the valve closing process by mechanical friction.

The special geometric form results in a thin-walled, low eddy current magnetic circuit with a light armature which permits rapid actuation at high magnetic force. Furthermore, because of the elongated armature, largely free of lateral forces, a reliable suspension results. In order to obtain sufficiently rapid setting movements with this electromagnet the bulk of the magnetic field energy must by supplied during the setting process in a very short time. To this end, an enormous electric power must be made available in a short time. In static operation the electric energy consumption is increased, as compared with magnetic circuits with only one coil, by the number of magnet coils. This is attributable to the fact that the electric excitation required for a given induction depends essentially only on the air gap length and not on the surface of the working air gap. On the whole, the magnetic circuit requires a high manufacturing cost. Winding of the core is complicated, and the multiple air gaps require very close machining tolerances. Further, the wear properties of the damping cones appear to be critical.

To simplify the manufacture of the electromagnet and to improve the efficiency of the electric energy conversion, the use of electromagnets with only one coil is appropriate, provided sufficiently high setting forces combined with sufficient leakage field and eddy current depletion can be achieved with them. Because of their simple mechanical design, cylindrically-symmetrical forms are favorable. The known electromagnetic injection valves with one magnet coil always have a closed electromagnetic circuit of solid, low-retentivity material of high permeability, with one or more air gaps active in pull-up direction, in which is formed the predominant part of the mechanical force that causes the armature movement. These air gaps may be referred to as working air gaps. To avoid sticking of the armature due to residual magnetic forces in the pulled-up or pulled-in state, the magnetic circuit is, as a rule, designed so that a small air gap remains when in the pulled-up or pulled-in state. This air gap is obtained by mechanical limitation of the armature stroke or also by providing a radial air gap directly around the armature. These remaining air gaps may be referred to in the following as residual air gaps. A similar effect can be achieved also by coating the armature and the magnet poles with thin, non-magnetizable films, which at the same time improve wear resistance and corrosion stability.

It is known that between smooth surfaces hydraulic adhesion forces result. To reduce the hydraulic adhesion and to improve the wear properties, a roughening of about 0.5 micrometers of the joint surface of the core or of the armature is recommended as in Federal Republic of Germany publication DE OS 3013694. One of the two joint surfaces should be made as smooth as possible.

It is generally believed that the pole cross-section should always be narrowed or at least not increased in the region of the working air gaps. By such means one always obtains the saturation induction of the magnet material in the region of the working air gaps with the armature pulled-up or pulled-in. As the mechanical force increases quadratically with the air gap induction, the maximum possible magnetic force is reached by saturation of the poles at a given pole cross-section.

To achieve high metering precision, rapid and low-bounce movement processes of the armature are required. The bounce can be considerably reduced by a supplementary mass disposed between armature and reset spring, the movement of the armature and supplementary mass being matched by appropriate selection of the mass and force conditions in such a way that toward the end of the first bounce cycle the movement of armature and supplementary mass occurs counter-directionally, and thereby the kinetic energy of the armature is to a large extent dissipated. Further, when using a suddenly changing spring characteristics in conjunction with the supplementary mass system, low-bounce movement processes with extremely short reset times are obtained. However, it is believed that the technological realization of such a characteristic in electromagnetic injection valves presents considerable technical difficulties because of the extremely small armature stroke and for this reason, very steep linear spring characteristics probably should be preferred.

The efficiency of the electric energy conversion is greatly impaired by leakage field lines, which do not go through the working air gap, and by eddy currents. The eddy currents can be greatly reduced by the use of thin-walled magnetic circuits. The degree of efficiency reduction by the leakage field is influenced most strongly by the geometric arrangement of the air gaps.

An electromagnetic injection valve with thin-walled magnetic circuit and flat armature have been described as in United Kingdom publication GB PS 14 59 598 and European Patent Office publication EP-OS 0 054 107. Electromagnetic injection valves with flat armature have a critical, poorly reproducible setting behavior because of deficient armature suspension. The efficiency of the electric energy conversion is low because in the dropped or released state these magnetic circuits have a strong leakage field because of the double working air gap and because of the unfavorable position of the air gaps below the coil.

By the use of thin-walled magnetic circuits with a bowl or cup-shaped armature the armature suspension and the electromagnetic efficiency can be improved substantially over flat armature magnetic circuits. For relatively large electromagnets the armature suspension is affected by a thin-walled guide tube. Although thereby the leakage field is substantially reduced as compared with flat armature magnets, there still is a considerable leakage field in particular in small electromagnets with relatively large armature strokes.

It is often believed that in magnetic circuits with a double working air gap the pull-up or pull-in speed is considerably reduced. (Example: flat armature magnet.) By comparison with a magnetic circuit with single working air gap (example: plunger magnet), here, at equal total pole cross-section and therefore equal maximum force, the working air gap length is doubled, and the pole surfaces are cut in half, whereby the inductance of the magnetic circuit at equal coil data is reduced to one fourth and the rate of exciting current rise is quadrupled.

Especially small armature masses are obtained with injection valve assemblies with spherical armatures. The spherical armature is usually disposed below the magnet coil. However, these injection valves have high leakage factors. The poles of these valves are either flat or conical. In the known injection valves with conical pole the attachment of the core is on the side opposite the pole, which leads to centering problems. It is now proposed as an improvement over the prior art to compose the magnetic circuit in part of thin metal sheets and to install it in a housing of non-magnetic material in order to reduce the eddy current losses.

In the injection valve shown in European Patent Office publication EP-OS 0 007 724, the spherical armature is reset by hydraulic forces, so that an additional reset spring is not necessary. The injection valve has a central bore with radially arranged slots. The inflow to the injection nozzle is partially closed by the spherical armature toward the end of the pull-up or pull-in process, so that through the throttling between the inflow bore and the rest of the space around the spherical armature a differential pressure results which creates the closing force. The magnetic circuit of this valve has a very large radially disposed residual air gap, in which the spherical armature is to be centered by hydraulic forces. In view of the fact that due to hydrodynamic oscillation processes stable stationary flow conditions do not prevail until a considerable length of time after the start of the opening movement, and because of strong radial magnetic interference forces occurring at the least of eccentricities, the stability and reproducibility of the armature movement appears doubtful.

To improve the atomization, it is customary for induction passage injections for Otto cycle engines to surround the fuel issuing from the injection nozzle with a secondary air stream. The secondary air stream is branched off behind the intake air filter of the internal combustion engine. The injection valve is disposed behind the throttle valve of the engine, so that the pressure gradient at the throttle valve is available to generate the secondary air stream. In prior art injection valves the secondary air stream has approximately the same temperature as the secondary air stream drawn in by the engine.

The prior art electromagnetic injection valves have inferior electromagnetic efficiencies. Nevertheless, in order to attain sufficiently rapid setting movements at low energy consumption, one uses, as a rule, special electronic actuating circuits which, during the pull-up or pull-in process excite the electromagnet with a powerful current surge, thereafter lowering the coil current by gating to the much smaller holding current. Excitation is effected directly with the respective onboard power supply voltage. For special requirements with respect to dynamics, a pre-excitation may be effected before the actual setting process. These actuating circuits are complicated and create additional costs. Prior art patent literature also disclose circuits for the actuation of electromagnets where a rapid excitation is achieved by capacitor discharge. Such circuits have not heretofore been used in electromagnetic injection valves.

Generally, the movement cycle of a conventional prior art electromagnetic injection valve can be divided into four main phases.

During the first phase after application of the exciting current no armature movement takes place. This phase is referred to in the following as pull-up or pull-in delay. The armature movement begins as soon as the magnetic force exceeds the mechanical counter-force. The length of time between the start of the armature movement and arrival in the end position of travel of the armature is termed pull-up or pull-in time. In the usual injection valves, the armature is firmly connected with the valve needle, therefore the valve needle executes the same movement as the armature. After disconnection of the exciting current, the reset movement of the armature is delayed by eddy currents and the electric damping of the coil and this time is called reset delay. The reset movement of the armature begins with the moment in which the mechanical reset forces exceed the magnetic force. The time during which the armature moved back into the inoperative position is referred to as reset time.

In electromagnetic injection valves, the effect of the coil resistance on the magnetic force buildup can be neglected at least at the beginning of the excitation. The magnetic force buildup is then independent of the armature movement. The magnetic force increases quadratically with the time. Because of the slow force buildup, little excess of force is available at the beginning of the pull-up or pull-in movement for the acceleration of the armature, so that, depending on the reset spring force, the stroke begins much more slowly still approximately with the third to fourth power of the time. It therefore generally takes the armature up to 75% of the pull-up or pull-in time to travel the first third of its stroke.

High-pressure injection valves require, at the beginning of the valve needle movement, a very high force to overcome the hydrostatic force which presses the valve needle onto the needle seat. This force, however, drops off very steeply at the start of the needle movement, since at a very short stroke a partial pressure equalization under the seat surface of the needle takes place, which, in turn, greatly reduces the hydrostatic force. Therefore, the force required for raising the valve needle decreases rapidly with increasing stroke to about 10 to 20 per cent of the opening force.

For the actuation of the valve needle in the usual electromagnetic high-pressure injection valves extremely strong electromagnets are required, the maximum magnetic force of which considerably exceeds the opening force of the needle and of the reset spring, so as to bring about sufficiently rapid setting processes. Toward the end of the pull-up or pull-in process, an extremely high excess of the magnetic force over the mechanical actuating force results, so that only a small portion of the magnet work serves to overcome the mechanical counter-force. Because of the very large excess of magnetic force, the reset delay is long. Even in case of pre-excitation of the magnet coil, the major part of the electric energy must be supplied during the brief pull-in process, so that when operating with the usual on-board power supply voltage of 12 volts the required peak currents may readily exceed values of 100 amperes.

The injection valve according to the invention, on the contrary, utilizes the kinetic energy of the armature to overcome the high hydraulic setting forces. To this end the armature is arranged so that it impinges on the valve needle at a relatively high speed only after having traveled about 30% of the armature stroke. Such an arrangement offers a number of advantages.

Firstly, with such an arrangement it is not necessary that the maximum magnetic force exceed the maximum hydraulic setting force, so that very small electromagnets with small armature mass can be used. Secondly, the movement time of the valve needle is much shorter than the pull-in time of the armature, so that already at a relatively slow excitation of the magnet coil a sufficiently rapid setting process is obtained. The work capacity of the electromagnet is utilized almost completely. The setting movement begins with a high initial speed, owing to which the pressure conversion occurs almost without delay in the nozzle holes, and therefore a high atomization of fuel is achieved immediately after start of injection. Typically the opening time is about 0.2 ms., unequalled until now in electromagnetic injection valves according to the invention. Despite the short setting times, the motion is soft and well reproducible with a low impingement speed toward the end of the setting movements, whereby the mechanical load on the structural parts and the wear properties are improved.

To obtain short reset times, there should be used in the area of the opening stroke of the valve needle a spring arrangement with supplementary mass and suddenly changing spring characteristic. That is, a supplementary mass is disposed between the armature and reset spring in such a way that after impingement on the armature the supplementary mass effectively detaches, relieving the armature of the reset spring force, so that upon rebounce of the armature a high excess of magnetic force is available for decelerating the bounce movement. The system is matched so that the then following collision of armature and supplementary mass is counter-directional, so that the kinetic energy of the armature is thereby dissipated to a large extend. Here, however, it was still believed that more stable movement conditions would be obtained with very steep linear spring characteristics than with suddenly changing spring characteristics. It has also now been discovered that it is possible to have systems with suddenly changing spring characteristic which have very stable movement conditions and are extremely insensitive to minor manufacturing imprecisions or respectively to possible wear. That is, a change of about 10% of the range of action of the strong spring causes, for example, in the range of the technically meaningful dimensions, only a variation of the setting time of about 2%. Because of the simpler manufacture, therefore, suddenly changing spring characteristics should always be preferred over steep linear ones.

Because of the high reset spring force, which is only just below the maximum magnetic force, the following resetting process occurs almost without delay with vary high initial acceleration. After impingement of the valve needle on the needle seat, the armature detaches and continues its travel with almost undiminished speed, so that a very high excess of force is available for reducing the otherwise prior art armature bouncing.

Furthermore, with a suddenly changing spring characteristic the reproducibility of the individual injections can be improved. Concerning this, consider first the disturbing influence of a fluctuating actuating voltage.

The injected quantity as a function of the duration of an electric actuating signal is composed of two parts, namely, the injected quantity during the transitional phases and a stationary portion. The stationary portion is adjusted, as a rule, by varying the valve needle stroke, whereby the flow through the injection valve is varied. The non-stationary portion of the injection quantity depends to a large extent on the dynamics of the injection valve, which can be acted upon by varying the reset spring force. Variation of the reset spring force affects, in the usual injection valves with single reset spring, both the pull-up process and the reset process. With increasing reset spring force the total pull-up time increases and the total reset time decreases. As the two effects are oppositely directed with respect to the injected quantity, wide dispersions of the reset spring force will result among the individual injection valves. Because of the wide scatter of the reset spring force, identical injection quantities will result for the individual valves only at a certain exciting voltage at which the calibration is carried out. At deviating exciting voltages, a scatter of the injection quantities results among the individual injection valve assemblies, which, of course, is undesirable.

Much more favorable conditions result with the injection valves with suddenly changing spring characteristic as proposed by Applicant. In such a proposed arrangement, only an adjustment of the high spring force with the armature pulled up is effected, while the low spring force at the beginning of the pull-up process remains almost uninfluenced. For the dynamics of the pull-up process, however, the spring force at the beginning of the pull-up process is almost exclusively determining. Therefore, only the drop-off process is notable influenced in the calibration, so that even at deviating exciting voltages uniform variations of the injection quantity result for all valves and are accordingly taken into consideration by the electronic actuating circuit.

Heretofore, it was generally believed that to reduce chatter there should be a firm, inflexible abutment. However, the chatter can be further reduced by making the abutment flexible. In this connection it is necessary, however, that by appropriate design of the abutment the natural frequency of the abutment is placed into a region where the rebounce movement of the valve needle and the movement of the abutment are counter-directional otherwise the chatter will be increased. With a flexible abutment, moreover, the mechanical shock at the moment of collision and therefore the wear are greatly reduced.

With the dynamic arrangement as herein proposed, where the maximum hydraulic force exceeds the maximum magnetic force, the valve needle should be pressurized by the system pressure on all sides. It is of course, possible also to seal the top and bottom of the valve needle from each other by a narrow guideway and to compensate the hydrostatic force remaining when the valve needle is open with a helical spring; then, however, at varying system pressure greatly varying setting forces will result which impair the reproducibility of the setting movement. In addition, the sealing of the valve needle requires extremely high precision and should the action of the helical spring force be eccentric the valve needle will be exposed to strong disturbing forces.

If the moving parts are exposed to the full system pressure, a special design of the various function surfaces is necessary in particular for high-pressure injection valves. In fact, when two smooth surfaces lie one on the other, the fuel film between these parts is displaced, and is removed from the action of the ambient pressure, so that, especially at high ambient pressures, the parts are firmly pressed together. This phenomenon is referred to in the following as hydraulic sticking. If the individual abutments of the valve system were given smooth surfaces, the parts would adhere firmly to each other after only a single actuation so that further operation would not be possible.

Closer study of the hydraulic processes in the moving gaps has shown that the gap flow can be divided into several phases.

In the first phase of the movement, as the gap closes, almost exclusively acceleration forces are active in the flow. Compared with the other forces, the amount of the mechanical reaction force is negligibly small.

As the gap continues to close, increasing energy loss occurs due to the kinetic energy of the outflowing liquid. This kinetic energy is almost completely whirled up and brings about a perceptible damping of the setting movement. The mechanical reaction force increases quadratically with the setting speed and also quadratically with the reciprocal value of the gap width. For annular gaps the reaction force increases with the third power of the gap width and for round surfaces even with the forth power of the diameter.

If the gap is very narrow, the friction forces finally predominate in the flow. They increase linearly with the setting speed and with the third power of the reciprocal value of the gap width. Toward the end of the movement, the friction resistance in the liquid is very great because of the narrow gap, so that removal of liquid is greatly hindered. Unless the movement speed has been greatly diminished by the preceding damping, there results an exceedingly strong pressure increase in the liquid between the gaps bringing about in conjunction with the compressibility of the liquid an almost loss-free movement reversal. This is hereinafter referred to as the liquid cushioning phase. In this phase, pressures up to several 1000 bar may occur even in low-pressure injection valves.

After the movement reversal, the gap volume increases. With parallel smooth gaps not enough liquid can follow from outside so that the flow is interrupted. Due to the then existing pressure decrease the air dissolved in the fuel is eliminated and cavitation phenomina occur.

By a geometric configuration of the gaps which permits a sufficient supply of liquid, the hydraulic sticking and interruption of the flow can be prevented.

In the evaluation of the hydraulic gap processes, the respective "Navier-Stokes equations" lead to complicated non-linear differential equations whose evaluation is possible only with numerical methods. Exact dimensioning rules can therefore be stated only for a specific case.

Generally, hydraulically favorable conditions result when one of the two abutting surfaces is ground in flow direction from the inside out with a surface roughness of about 1–5 micrometers, while the other is made very smooth for example by lapping. The carrying share of the ground surface should not exceed 10%. To reduce wear, both abutment surfaces are hardened, preferably by nitriding. The abrasion gaps in flow direction also permit the removal of any small particles breaking out, so that the further flow of liquid is not hindered.

Another possibility for preventing hydraulic sticking consists in that one of the two abutment surfaces is formed in collar form, dish form, or membrane form with little cushioning capacity and rests on the other abutment surface in ring form when the gap is closed. As the mechanical force changes, the parts can detach and roll off on each other first at the edge and then progressively farther inward in flow direction, so that a largely unhindered supply of liquid into the gap is possible. The interaction of the parts can be further improved by a slight barrel shape of one of the two abutment surfaces. If the abutment surfaces are sprung, the natural frequency of the abutting parts should, as has been described, be matched in such a way that a counter-directional collision results.

Further, one of the two abutting surfaces may be beveled, so that the gap cross-section increases from the center outwardly. The angle of the bevel preferably should not exceed 1° and should usually be even much less. For gaps with very large surfaces, a strong damping can thereby be achieved toward the end of the setting movements, largely suppressing the always existing chatter.

The remaining hydraulic effect on the movement of the individual parts of the injection valve are quite minor, provided sufficient cross sections for pressure compensation exist. This is attributable to the fact that any pressure disturbances are compensated at the speed of sound in the fuel. By contrast, the maximum movement speeds of the individual parts, about 1–2 microseconds, are very low, so that in the evaluation of the hydraulic effects on the movement conditions, with the exception of the gap processes, a hydrostatic approach is sufficient.

Nevertheless, strong hydrodynamic oscillations may, of course, occur, but they have little influence on the movement of the individual structural parts. Such oscillations can be employed for controlled influence on the injection process. Care must be taken, however, that these oscillations occur only at the injection nozzle itself and are not coupled into the connecting lines between the individual injection valves, in order to stabilize the system pressure before the individual injection valves and not to impair the reproducibility of the individual injection processes. This is appropriately achieved by disposing compressible elements in direct vicinity of the injection nozzles or respectively the valve member. As the amplitude of the pressure oscillations depends directly on the flow velocity of the fuel, the inflow cross-sections to the individual injection valves should be taken as large as possible.

In low-pressure injection valves for induction passage injection, the atomization quality can be improved in known manner by supplying atomization air. In the known injection valves, the atomization air is branched off behind the intake air filter of the engine. The injection valve is disposed behind the throttle valve of the engine, so that flow of the atomization air is brought about by the pressure difference resulting at the throttle valve. With the throttle fully open, however, there is no longer any appreciable pressure difference, so that the flow of the atomization air almost ceases.

On the other hand, however, with the throttle open, a strong engine intake air stream exists which leads to a perceptible pressure drop at the intake air filter of the engine. Owing to this, there exists in the induction passage of the engine, at least during considerable time portions of the respective cycle, a sufficient vacuum relative to the ambient air, which can be utilized to create high atomization air speeds. As an example, already at a vacuum of 50 mbar there results an air flow velocity of about 100 m/s—a value at which a very good improvement of the atomization is achieved.

Utilization of the induction passage vacuum is possible also with the throttle fully open if the atomization air is taken from a separate air filter which serves exclusively for the filtering of the atomization air. This measure is especially effective because low induction passage vacuums are linked with high combustion air velocities and therefore with great throttling at the intake air filter, whereas the throttling at the atomization air filter decreases because of the decreasing atomization air speed. An especially simple and effective design results if the separate atomization air filter is disposed directly at the injection valve and the atomization air is guided through the coil space of the injection valve, so that at the same time improved coil cooling is achieved.

An additional great improvement of the atomization and of the engine efficiency can be achieved by heating the atomization air. To this end, a heat exchanger, which may consist, for example, of a spiral tube, is disposed directly in the hot engine exhaust gas stream. The heat exchanger is placed between the air filter and the atomization device. Thus, with the throttle closed, almost exclusively high-temperature atomization air is supplied to the engine as combustion air. Thereby the fuel is excellently nebulized and precipitation of fuel on the induction passage walls is reduced. The high intake air temperatures reduce the ignition delay in the partial-load range and thereby improve the efficiency of the engine. The improved combustion process permits expansion of the lean range of the engine and reduces pollutant emission. With increasing opening of the throttle, the hot atomization air stream is increasingly mixed with cold air, so that the temperature of the combustion air decreases. In this way a sufficient margin from the knock limit of the engine is ensured. With the throttle fully open, the heating of the combustion air is now insignificant because of the small proportion of atomization air, although here, too, a great improvement of the atomization is achieved because of the high temperature of the atomization air. Furthermore the flow velocity of the atomization air is greatly increased by air-heating especially at low pressure differences, since increasing air temperature at equal pressure difference always brings about a strong increase in flow velocity. Furthermore, because of the good adaptation of the mixture preparation to the requirements of the engine characteristics, a considerably smaller adjustment range of the ignition is required.

The heating of the atomization air may, however, lead to considerable problems with the injection due to vapor bubble formation of the fuel in the injection valve. To prevent vapor bubble formation, therefore, heat insulation of the injection valve from the atomization device and additional cooling of the injection valve by flushing with fresh fuel is preferable.

At high loads, the performance of Otto cycle engines is limited by engine knocking setting in. In modern engines this is prevented by throttling back the pre-ignition as a function of the signals of a knock sensor. With the pre-ignition throttled back, the engine efficiency is reduced. At high engine loads the efficiency can be improved by water injection. Thereby the combustion peak temperatures are greatly reduced without leading to a reduction of the efficiency of the motor combustion. From the lower peak temperatures a considerable decrease in nitric oxide is to be expected. It is, as a rule, not necessary to throttle back the pre-ignition and usually it can be further increased. Excellent adaptation to the engine characteristics is possible by injection of water at low pressure into the induction passage of the engine through an electromagnetic injection valve as a function of a knock sensor signal. This measure reduces the water consumption. And since water is fed only at high loads and therefore at high engine temperatures, condensation of the water in the engine and therefore increased corrosion need not be feared. No special requirements need be set for the atomization quality, as the water reaches the engine only in relatively thick drops anyway, and evaporation takes place only toward the end of the compression process and during the combustion process. Suitable for the supply of water are therefore also simple water carburetors (gasifiers) which consist only of a main nozzle system and float chamber, and in which the supply of water is controlled by a simple solenoid dependent on the engine ignition knocking.

In experiments it has now been found that with water injection the combustion occurs almost without residue and the deposition of combustion residues in the engine is almost completely prevented. Furthermore, when using the described system also in Otto cycle engines nearly any degree of supercharging is possible, limited practically only by the mechanical strength of the engine. The injection of water takes place in supercharging always before the supercharger, to achieve an additional improvement of the atomization by mechanical forces and an improvement of the supercharger efficiency.

The injection of water permits, also for conventional Otto cycle engines, the use of fuels with a very low octane number, without having to throttle-back the compression ratio of the engine. An especially good adaptation to the engine characteristics is achieved with the injection of water in conjunction with the previously described hot air atomization.

To obtain reproducible fuel injection quantities, calibration of the injection valves is always necessary. The calibration of the injection valves is normally done with fuel. The manufacture of low-pressure injection valves is done with air with respect to the stationary component of the fuel flow similar conditions are obtained if the Reynolds Numbers of air flow and fuel flow are in agreement. Furthermore, the air velocities must be considerably lower than the velocity of sound if air, in order to obtain comparable conditions. The differential pressure for the creation of the air flow may therefore be only some 10 mbar. Now, however, the kinematic viscosity of air in the ambient state is much greater than that of fuel. The kinematic viscosity of air can be reduced by a pressure increase. Generally an air pressure of 5-10 bar is sufficient, which this is considerably higher than the usual fuel injection pressure of about 0.7 to 3 bar.

The valve setting processes are generally greatly influenced by hydrostatic forces. The calibration of the dynamic behavior and hence of the non-stationary component of the fuel injection quantity occurs, therefore, at an air pressure which corresponds to the fuel injection pressure. This, of course, does not take into consideration the damping of the setting movements by the fuel and the effect of the hydrodynamic oscillations; however, the end points of the respective setting movements, which most influence the non-stationary components of the injection quantity, are well reproducible. Any deviations can be taken into account in this calibration method by appropriate correction factors. Measurement of the movement process of the armature can be effected, for example, by photo-cells or by evaluation of the electro-dynamic voltage reaction in the magnet coil.

In the proposed injection valve, which utilizes the kinetic energy of the armature to overcome the opening force, sufficiently short setting times can be obtained even at relatively long armature pull-up or pull-in times. This requires minor flux increase rates in the magnetic circuit. At low flux increase rates, the eddy current formation is also greatly reduced, thus making it possible to use relatively thick-walled magnetic circuits. Because of the greatly reduced losses, the maximum power requirement is lowered by about one order of ten as compared with the usual design.

In the ideal case, the magnetic force buildup is, at equal initial inductance, independent of whether the electromagnet has a single or a double working air gap. In the ideal case, the magnetic force depends only on the energy stored in the magnetic field and on the armature stroke. The electric energy consumed in a given period of time, neglecting the coil resistance, depends only on the initial inductance of the electromagnet.

In electromagnets with a double working air gap, the number of turns of the exciting coil must be quadrupled in order to obtain the same inductance as with a magnet with single air gap, so that at equal current path and equal current density the winding cross-section must also be quadrupled. Furthermore the cross-section of the poles is cut in half and the total air gap length is doubled. This makes the reluctance of the magnetic circuit and hence the leakage field of the electromagnet such greater. As the magnetic force decreases quadratically with the leakage factor, the leakage field is of special importance for the dynamic behavior. The leakage field increases the inductance of the coil and greatly reduces the magnetic force in the saturation range with the armature dropped.

On the other hand, in electromagnets with double working air gap the eddy current formation is reduced to about one fourth because of the halved wall thickness of the magnetic circuit. To achieve a sufficient eddy current depletion, the wall thickness of the magnetic circuit preferably should not exceed 0.5-1 mm.

With such small wall thicknesses, however, at the usual injection valve dimensions and with the armature dropped, the magnetic resistance of the air gaps is considerably greater than the resistance between core and yoke, so that a strong leakage field forms, which bypasses the air gaps. In low-pressure injection valves with flat armature magnet, for instance, the leakage field flux may, at the usual magnetic circuit dimensions, amount to as much as 75% of the total flux, so that the efficiency of the electromagnetic energy conversion decreases in the same proportion. As the dynamic behavior of the electromagnet is determined mostly by the speed of field buildup at the beginning of the pull-up movement, it is especially important to reduce the leakage field to obtain rapid, low-loss setting movements.

Favorable efficiencies are attainable only with special pole arrangements. At small pole cross-sections, electromagnets with one working air gap are favorable because of the reduced reluctance. The working air gap should preferably be placed approximately in the center of the coil, since at this point a flux concentration is located which permits a low-loss energy conversion. In electromagnets with double working air gap the best efficiency results with a bowl-shaped armature which embraces the coil and whose poles are arranged so that they each cover about one fourth of the coil. In the case of elongated coils, the leakage field is then reduced by about 75% as compared with a flat armature magnet with equal pole cross-section and equal coil dimensions. With the pole arrangement an equally good efficiency is obtained as with an electromagnet with single working air gap in the center of the coil, but with halved magnetic circuit cross-section and therefore greatly reduced eddy current losses at equal magnetic force.

In electromagnets with bowl-shaped armature, however, the sealing and anchoring of the magnet coil is difficult. In this respect, magnetic circuits with double working air gap are favorable where the outer pole of the armature is formed by a collar of small diameter. Such electromagnets are described in Federal Republic of Germany publication DE OS 3149916 and European Patent Office publication EP OS 0076459. Both electromagnets have a short armature, the poles of which are located below the coil and therefore have strong leakage fields. In particular for the electromagnetic injection valve described in said DE OS 3149916 it would seem that because of the relatively thick-walled magnetic circuit hardly any improvement over the known injection valves with single working air gap will result. One advantage of this design, however, is the almost lateral force-free magnetic force buildup even in case of possible slight eccentricities of the armature suspension.

Considerably better efficiencies are obtained with such electromagnets if the inner pole is arranged above the coil center. The highest magnetic force is obtained when the pole cross-sections are approximately the same, and the inner pole is arranged approximately at the level of the upper fourth of the magnet coil. For low-pressure injection valves with appropriate dimensions often only small magnetic forces are required, which can then be supplied with a single working air gap and a wall thickness of the magnetic circuit of about 0.5 mm. Here, too, a double working air gap is favorable in order to achieve a lateral force-free armature suspension. To this end the pole cross-section of the outer pole can then be greatly increased, to reduce the reluctance of the respective air gap and hence the leakage field. With such a layout the best efficiency is obtained if the inner pole is arranged approximately in the center of the coil.

At very low mechanical counter-forces and small armature mass, low magnetic forces are required. In low-pressure injection valves, therefore, the pole cross-section, in contrast to the usual dimensional designs, can even be enlarged as compared with the magnetic circuit cross-section, in order to reduce the reluctance of the air gaps and hence the leakage field with the eddy current losses being reduced at the same time. With such an arrangement, an almost loss-free energy conversion is obtained. The reduced reluctance permits, at equal thermal load and equal inductance as in a conventional electromagnet, the use of much smaller magnet coils with a small number of turns. On the other hand, with the usual dimensioning, where in the interest of a low leakage field the pole cross-section is not greater than the rest of the magnetic circuit cross-section, high saturation induction forces result which far exceed the mechanical counter-force and thus lead to a long reset delay. The reset delay must then be reduced by an electronic holding current reduction. By contrast, the herein proposed arrangement permits using simple actuating circuits without holding current reduction with the dynamics being improved at the same time. In addition, the proposed arrangement permits, in a simple manner, the improvement of electromagnetic injection valves already in production in that the core cross-section is reduced above the pole in an essential part as by drilling open.

Another major leakage field reduction can be achieved at the usual magnetic circuit dimensions in particular for small electromagnetic injection valves by providing the housing means of the rotationally-symmetrical, all-enclosed magnetic circuit with large-area openings. Thereby the reluctance between housing and core is increased, so that the strength of the leakage field is reduced.

In high-pressure injection valves, the creation of sufficient magnetic forces requires large pole cross-sections, the air gap having only a low reluctance. With the above measures the leakage field can be further reduced, so that sufficiently high electromagnetic efficiencies result also with materials of very low permeability. This permits the use of powder composite materials, where a low-retentivity powder is embedded in an insulating plastic. These materials have a high electric resistance, so that the formation of eddy currents is prevented almost completely. In general, however, the maximum relative permeability cannot exceed values of 200–300. With such materials compact magnetic circuits can be constructed, which have a sufficient mechanical strength and can withstand high pressures. For reliable suspension the armature is connected as with a long thin-walled guide tube, which serves at the same time as abutment, so as not to expose the mechanically relatively soft magnet material to impermissible stresses. The armature can be made by integral pressing with the guide tube in one operation. For increased magnetic flux the thin-walled guide tube may consist of low-retentivity material, which is surface-hardened as by nitriding to improve the wear properties. In this hardening process the low-retentivity properties are reduced only little. When using sufficiently pressure-resistant coils, the magnet material can be pressed directly around the coil, to facilitate the sealing and to simplify the manufacture.

For high-pressure injection valves the usual wire coils are not very suitable. Here only few turns and hence only few courses of turns are required to obtain sufficiently low inductances. Between the ends of the individual courses high induction peaks will occur, in particular upon switching off, which endanger the insulation of the coil. Much more favorable is the use of foil coils, which permit a much higher mechanical as well as electrical stress. Produced in quantity, such foil coils are also less expensive than wire coils. The coil may consist for example of oxidized aluminum foil, so that an insulating intermediate layer may be dispensed with. Also a coil former may be dispensed with, so that also a better utilization of the winding space is obtain. To improve the mechanical strength, the coil is preferably impregnated with plastic under vacuum. Contacting can be effected, for example, through metal sleeves slit lengthwise, to further improve the mechanical strength. Another possibility is to fold the foil ends over and to bring them out at right angles to the winding direction. At sufficient coil strength it is favorable to clad the coil directly, possibly in several operations, with powder composite material.

If the coil space is sealed, the use of ceramic coil formers is favorable. As material the newly developed high-strength ceramic materials known from engine and turbine construction are preferably used. To improve the load capacity of the coil former, the coil should be wound at highest possible traction, to obtain a mechanical pre-stress of the coil former.

SUMMARY OF THE INVENTION

According to one aspect of the invention an electromagnetic fuel injection valve assembly for injecting fuel to an engine comprises an electromagnet having an armature and armature-actuated valve member the mass of which is substantially less than that of the armature and which is not fixedly connected to the armature thereby enabling the armature to exert a force on said valve member in only one direction, wherein prior to the start of an actuation cycle the armature is retained in an inoperative or stable position by a restraining device which may be a reset spring, wherein the holding or retaining force of said device is only a fraction of the saturation force of the electromagnet, wherein after overcoming said holding force the armature travels a major part of the armature stroke without transmitting any substantial forces to said valve member, and wherein after traveling a major part of the armature stroke the armature impinges on the valve member at a relatively high speed and in so doing pushes the valve member in the direction of armature movement so that a substantial portion of the opening work is achieved by the kinetic energy of the armature and of the parts connected with the armature.

Other general specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted for purposes of clarity:

FIG. 3-B, in fragmentary and cross-sectional view, illustrates an electromagnet, as for a high pressure injection valve assembly, employing teachings of the invention, wherein a powder composite material is employed in combination with a collar-like outer pole;

FIG. 3-C, is a relatively enlarged view of a fragmentary portion of the structure depicted in FIG. 3-B;

FIG. 4-A is a partial view, in cross-section, of an electromagnet employing teachings of the invention wherein a collar-like outer pole of low-retentivity material is employed;

FIG. 4-B is a view somewhat similar to that of FIG. 4-A but, in effect illustrating a modification of alternate form thereof;

FIG. 6 is a graph illustrating the relationship as between the magnetic force and mechanical counterforce, of the injection valve depicted in FIG. 5, as a function of the path of travel, S;

DETAILED DESCRIPTION OF THE PREFERRED EMBODIMENTS

Figure 1:
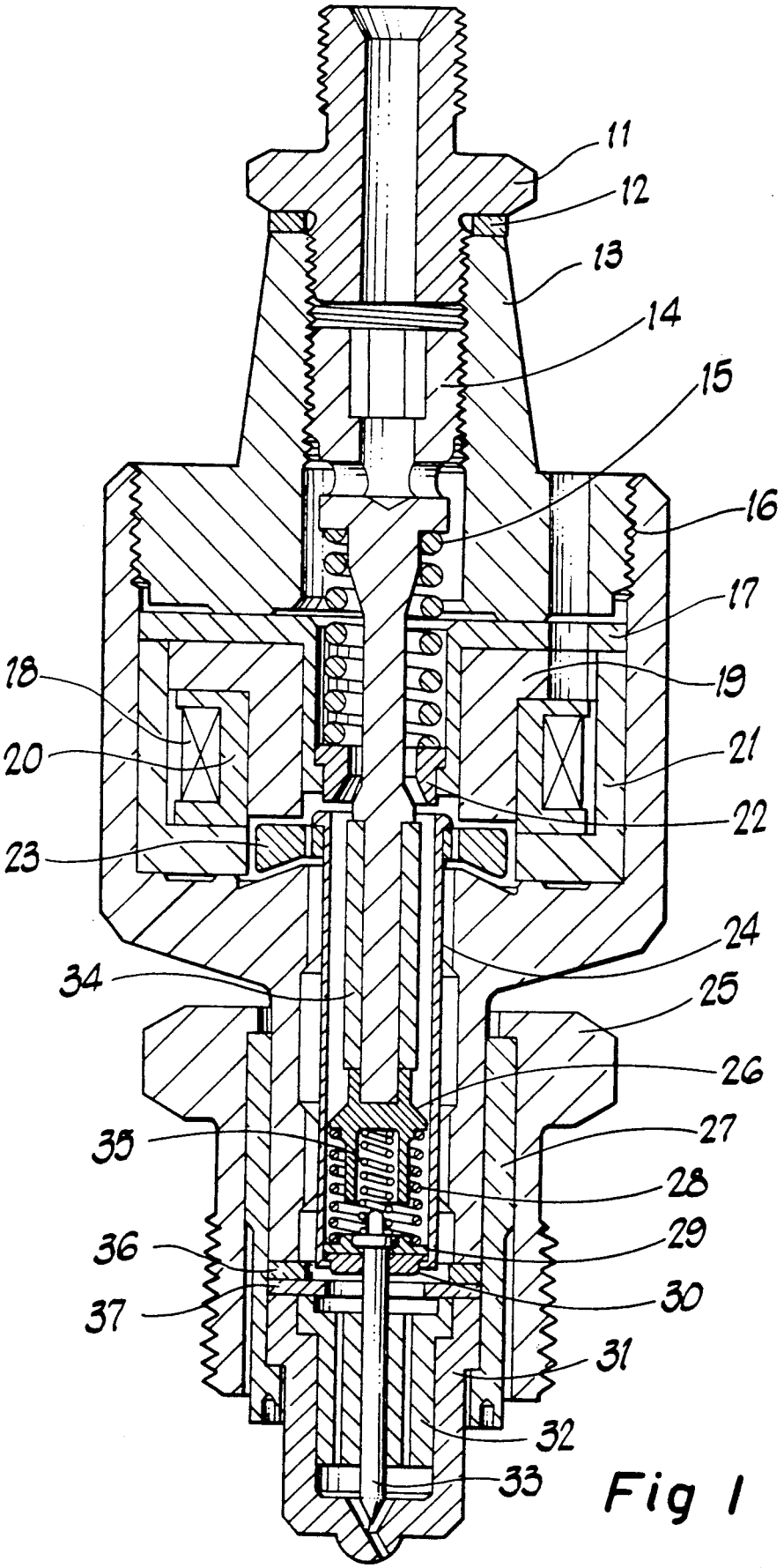
FIG. 1 is a longitudinal axial cross-sectional view of a high pressure type injection valve assembly embodying teachings of the invention.

Referring not in greater detail to the drawings, FIG. 1 illustrates a, preferably, high pressure type electromagnetic injection valve assembly having an electromagnet comprised of power composite material. The electromagnet consists of a core 19, yoke 21, and armature 23. The coil 18 is located on the ceramic coil former 20. The core 19 extends almost to the lower end of the coil former 20, in order to thereby mechanically relieve the coil former. Hence a ceramic material of relatively low strength may be used for the coil former. The magnetic circuit has only one working air gap in order to obtain as large as possible a pole surface. Accordingly, despite the per se unfavorable position of the working pole below the coil and despite the low permeability of the magnet material, still acceptable leakage factors are obtained. Due to the small diameter of the lateral pole, the underside of the coil former is completely covered. Owing to this, the entire magnetic circuit can be firmly compressed in longitudinal direction, to permit reliable sealing. The sealing may be facilitated by the use of sealant or adhesive. The electromagnet is installed in the housing 16, which preferably consists of high-strength non-magnetizable austenitic cast iron. The housing is provided with a cover 13, which is screwed into the housing. The abutment 17 serves to fix the residual air gap remaining under the central pole when the armature is pulled-up and for the suspension of the supplementary mass 22. The plate or disk shaped portion of abutment 17 above the electromagnet further serves to protect the relatively soft powder composite material against damage when screwing on the housing 16. The core 19 is firmly connected with the abutment 17 preferably by a suitable adhesive or immediately by a press-fitting thereof during the core production, to make possible joint machining of the pole surface of the core and of the abutment surface of the abutment in one clamping device. Further it is appropriate also to armor the yoke 21 at the bearing points in the housing with a firmly connected plate, to reduce the danger of damage during assembly. To reduce the reluctance, these plates may also be made of thin low-retentivity material, which is surface-hardened preferably by nitriding to improve the wear resistance. By the proposed form of the magnetic circuit a small pressurized inside diameter of the injection valve is made possible, whereby the mechanical stresses are reduced. This permits the use of a relatively thin-walled compact housing.

The supplementary mass 22 protrudes slightly over the abutment surface of the abutment 17, so as to obtain a suddenly changing characteristics of the reset spring force. The protrusion of the supplementary mass is selected so that the force of the strong spring 15 is operative toward the end of the pull-up process over a distance of about 30–50% of the valve needle stroke. The amount of protrusion is relatively uncritical, so that at appropriate manufacturing precision adjustment of this amount can be dispensed with. The spring force of the strong spring 15 and therefore the mechanical reset force toward the end of the pull-up process is adjusted with the adjusting screw 14. At its lower end the adjusting screw carried a spring guide sleeve 26, which carries two relatively weak springs 28 and 35. The two springs have only a slight rise of the spring characteristics, so that the spring force changes little even when the adjusting screw 14 is readjusted. The inner spring 35 serves to press the valve needle 33 onto the needle seat even when there is no system pressure, and to ensure thereby always a reliable seal also in the standstill phases of the engine. The outer armature reset spring 28 generates the mechanical initial force at the beginning of the armature movement and prevents the armature from bouncing against the valve needle again toward the end of the reset process, which would result in a further undesired lifting off of the valve needle. The force of the armature reset spring is transmitted via the spring plate 29 to the intermediate piece 30. The intermediate piece 30 is placed into the thin-walled armature guide tube 24.

The armature stroke and the valve needle stroke are adjusted by selection of adjusting disks of different thickness. Here the adjusting disk 36 serves to adjust the armature stroke and the adjusting disk 37 serves to adjust the valve needle stroke. The adjusting disks are firmly pressed against each other with the nozzle body 31 by means of the clamping sleeve 27. The injection valve is screwed into the cylinder head of the engine with the cap nut 25. Guiding of the valve needle 33 occurs through the needle guide 32.

The needle guide 32 may be provided with relief notches, to achieve a uniform pressure distribution in the guide gap. This measure is meaningful for the proposed injection valve, in contrast to the usual injection nozzles, because here substantially different operating conditions prevail. Furthermore the valve needle can be installed with relatively large play, to achieve, within certain limits, a self-centering of the needle. The required manufacturing precision for the valve needle guide is much less than for the usual mechanical injection nozzles, as a special sealing function of the guide is not required.

The nozzle body 31 is made relatively thin-walled at its underside, to achieve a low natural frequency. The natural frequency is selected so that the bouncing of the valve needle, which anyway has a duration only in the microsecond range, is further reduced by counter-directional movement of the plate-shaped bottom portion of the nozzle body. In addition, the flexible form reduces the mechanical load on the valve needle seat.

In the injection valve presented, it is possible, by appropriate selection of the diameter and length of the inflow lines to the valve seat and by appropriate selection of the fuel volume below the valve needle guide, to obtain almost any desired injection processes. In the illustrated injection valve, the inflow lines in the valve needle guide 32 are made relatively thin. This results in a sharp pressure drop as the valve opens, by which strong oscillations of the injection process are excited. Such a pattern may be favorable for some engines. The frequency of the oscillation is determined essentially by the length of the inflow line. For short inflow lines also an oscillation with a relatively low frequency can be obtained by utilizing the volume resonance of the fuel volume below the valve needle guide. Such a layout can be utilized to achieve a pre-injection before the actual main injection. In general, however, the inflow lines will be designed with as large as possible diameter, so as to obtain an almost oscillation-free, steeply rising injection pattern and to reduce the mechanical force requirements for opening the valve needle.

In the illustrated injection valve a damping element 34 is further provided, consisting of a plastic of much greater compressibility than that of the fuel. Thereby a reduction of pressure oscillations and an accumulation effect can be achieved. In addition, the sojourn of the fuel in the injection valve is thereby shortened. Use of such a damping element is, however, meaningful only for relatively low fuel pressures. The movement pattern of the injection valve according to FIG. 1 will now be further elucidated with reference to FIGS. 2-A, 2-B and 2-C. All characteristics represent the real movement cycle true to scale.

Figure 2A:
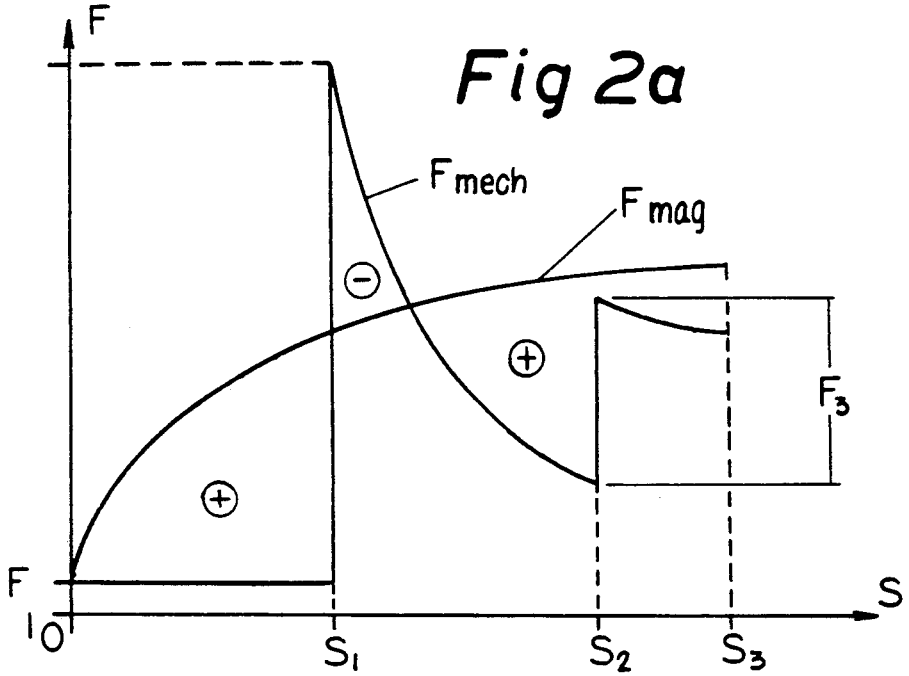
FIG. 2-A, 2-B and 2-C are graphs respectively depicting the movement cycle of the armature means and associated structure during the pull-in processes of the embodiment depicted in FIG. 1.
Figure 2B:
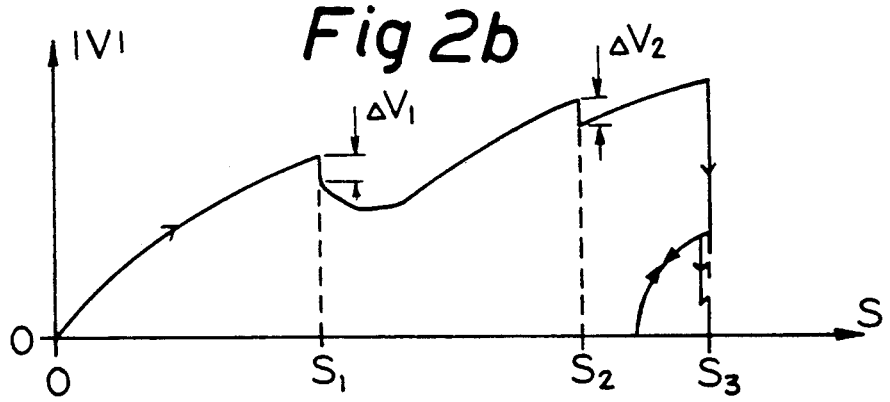
Figure 2C:
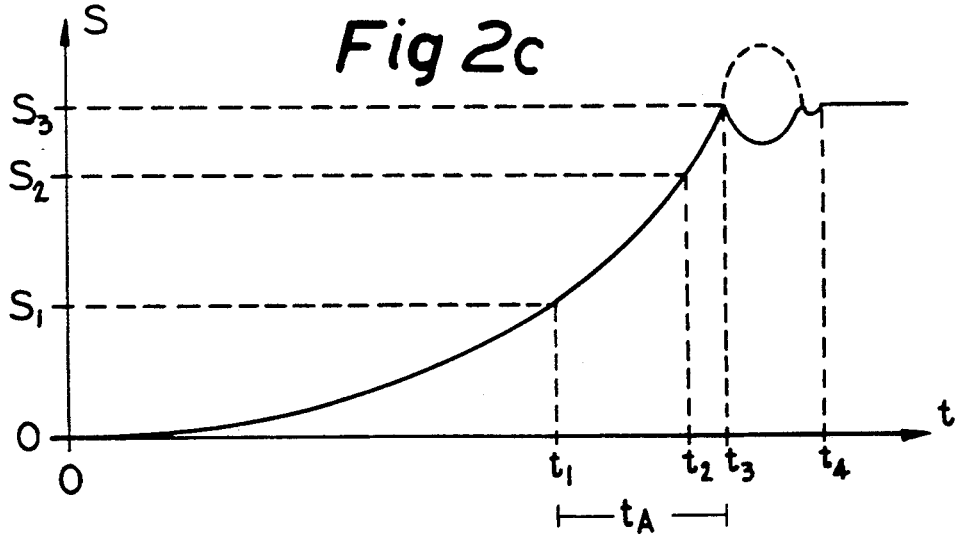

FIG. 2-A shows the characteristics of magnetic force $F_{mag}$ and of the sum of all mechanical counter forces $F_{mech}$ as a function of the armature path S. It can be seen that the magnetic force increases very rapidly with increasing path. At first glance this is surprising, since the magnetic force increases approximately quadratically with the time, and hence at first very slowly. This slow increase of the magnetic force, however, is connected with an equally slowly increasing armature acceleration, so that in the first phase only a short armature path is traveled. Therefore, despite the slow magnetic force buildup, a high kinetic energy is available for overcoming the valve needle opening force already after short paths.

The armature movement begins as soon as the magnetic force exceeds the force of the armature reset spring. Having traveled path $S_1$, the armature strikes against the valve needle. The work integral available for armature acceleration upon pull-up is shown in this figure as a hatched area.

FIG. 2-B shows the variation of the armature speed as a function of the armature stroke S, and FIG. 2-C shows the armature stroke S as a function of time,t. It can be seen that already after traveling the short path $S_1$ the armature speed is more than half the final speed. For this short path, however, the very long time, $t_1$, is required and amounts to much more than half the total pull-up time.

After impingement of the armature on the valve needle, because of the impact loss, there results the velocity loss, $\Delta v_1$, which because of the great difference in mass between armature and valve needle is very small. The mechanical counter-force increases abruptly and considerably exceeds the magnetic force. The opening work drawn from the kinetic energy of the moving parts is shown in FIG. 2-A as a cross-hatched area. By it the opening speed is slightly reduced. After the mechanical counter-force has fallen below the magnetic force, the velocity rises again.

After path $S_2$ has been traveled, the moving parts impinge at time, $t_2$, on the supplementary mass, owing to which another slight impact loss occurs. The velocity diminishes slightly, in order then to increase further with a lesser gradient. The opening process of the valve needle ends at time, $t_3$. The opening process takes only the comparatively short time span, $t_A$.

At time, $t_3$, the armature strikes against the armature abutment and bounces back. This causes a considerable energy and velocity loss, as the abutment is fixed and immobile. The supplementary mass, however, continues its path unchecked and thus relieves the armature of the predominant part of the reset spring force. Thereby the subsequent bounce process is substantially shortened, and if the mass of the supplementary mass has been chosen correctly, the remaining kinetic energy is largely dissipated in a further counter-directional collision of armature and supplementary mass. The path of the supplementary mass is shown in FIG. 2-C as a dotted line. The amount of the velocity loss can be read from FIG. 2-B as to order of magnitude. In all there results an extremely rapid, soft movement pattern, in which the mechanical load on the structural parts is much lower, because of the low maximum velocity, than in conventional injection valves.

For the injection valve according to FIG. 1 an electromagnet unfavorable as to efficiency was used, but which permits the use of a ceramic coil former of relatively low strength. Some more favorable forms in terms of magnet construction are illustrated in FIG. 3.

Figure 3A:
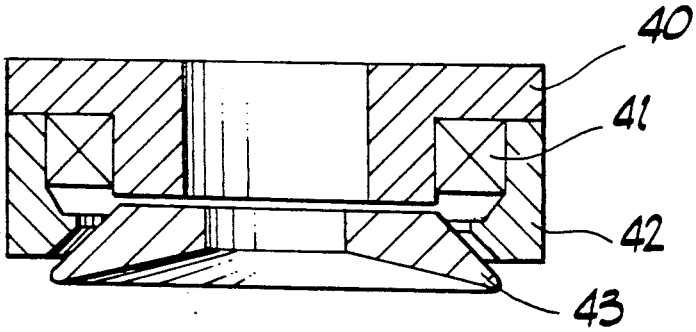
FIG. 3-A, in fragmentary cross-sectional view, illustrates an electromagnet, embodying teaching of the invention, wherein a double working air gaps is employed.
Figure 3B:
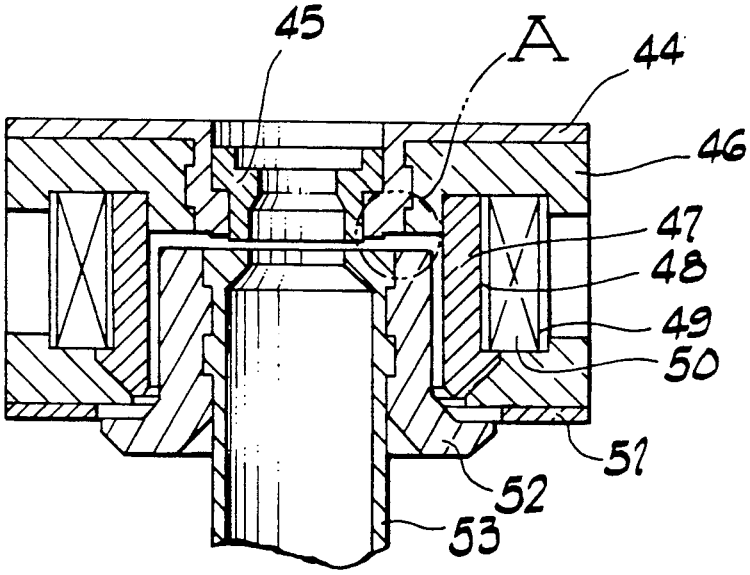
Figure 3C:
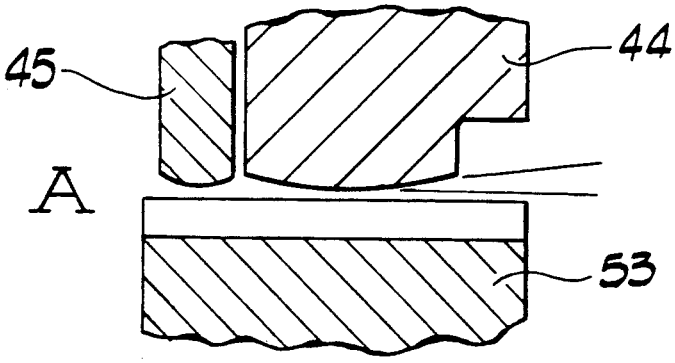

FIG. 3-A shows an electromagnet with double working air gap. The electromagnet consists of a core 40, coil 41, and armature 43. The outer working air gap is arranged obliquely, to obtain low reluctance at simultaneously reduced radial forces in case of eccentric suspension. To further reduce radial forces and to make the armature dimensions smaller, the outer working air gap may be provided with two or more steps. The magnetic circuit consists of powder composite material.

FIG. 3-B shows an electromagnet for a high-pressure injection valve of powder composite material with a collar-like outer pole. The electromagnet comprises an armature 52, guide tube 53, and yoke 46. The foil coil 50 is contacted with two slit or slotted metal sleeves 48 and 49 and mechanically reinforced. The coil former 47 consists of high-strength ceramic. The inner pole is disposed in the position most favorable in terms of magnet construction, so that the armature covers about ¾ the coil length. The yoke 46 is mechanically reinforced on the underside with the metal plate 51 and on the top side with the abutment 44. The abutment 44 serves at the same time for the suspension of the supplementary mass 45. The abutment and the coil are pressed in one operation integrally with the yoke and the guide tube with the armature. At its outer circumference the yoke is provided with large area openings, to reduce the leakage field.

FIG. 3-C shows the abutting surfaces of the electromagnet according to FIG. 3-B as an enlarged detail. The guide tube 53 is provided with radial grooves for pressure compensation when the gap is closed. The surface of the guide tube is hardened and lapped. The abutting surfaces of abutment 44 and supplementary mass 45 are beveled on both sides, to prevent hydraulic sticking. Compared with a unilateral bevel, the bilateral bevel reduces the mechanical load on the abutting surface. The abutting surfaces can, of course, also be ground in radial direction in the manner already described.

FIG. 4-A shows an electromagnet with collar-like outer pole of low-retentivity material. For simpler manufacture, the armature and guide tube are one part 66. As the requirements for the permeability of the magnet material are not too high, the armature consists preferably of annealed special steel of high specific electric resistance, and is nitrided or otherwise provided with a wear-resistant coating to improve the wear resistance. To reduce the eddy current losses, the armature may be slit lengthwise. The wall thickness of the armature is preferably 0.5–1 mm. For greater required forces and hence greater required wall thicknesses the armature is preferably 0.5–1 mm. For greater required forces and hence greater required wall thicknesses the armature is assembled from two or more firmly connected insulated sleeves slipped one over the other. The magnetic flux return occurs via the core 60, the large-area pierced jacket consisting of two concentric parts 61 and 62, and the lower yoke plate 65. The foil coil 63 is reinforced with a tubular ceramic coil former 64.

For further reduction of the eddy current losses the electromagnet according to FIG. 4-B is partially composed of sheet laminations. The armature 72 of powder composite material is pressed onto the guide tube 73, which may also consist of low-retentivity material. The inner pole is disposed above the coil, to facilitate manufacture of the sheet packet 67 from flat sheets. Even for strong electromagnets packets of 2–4 sheets are as a rule sufficient. However, intensified eddy currents still occur in this electromagnet mainly at the abutment points of the sheets because, here, the direction of the lamination does not coincide with the flux direction. These eddy current losses can be reduced by bending or flanging of the individual sheets in flux direction, involving, however, more expensive manufacture.

Figure 5:
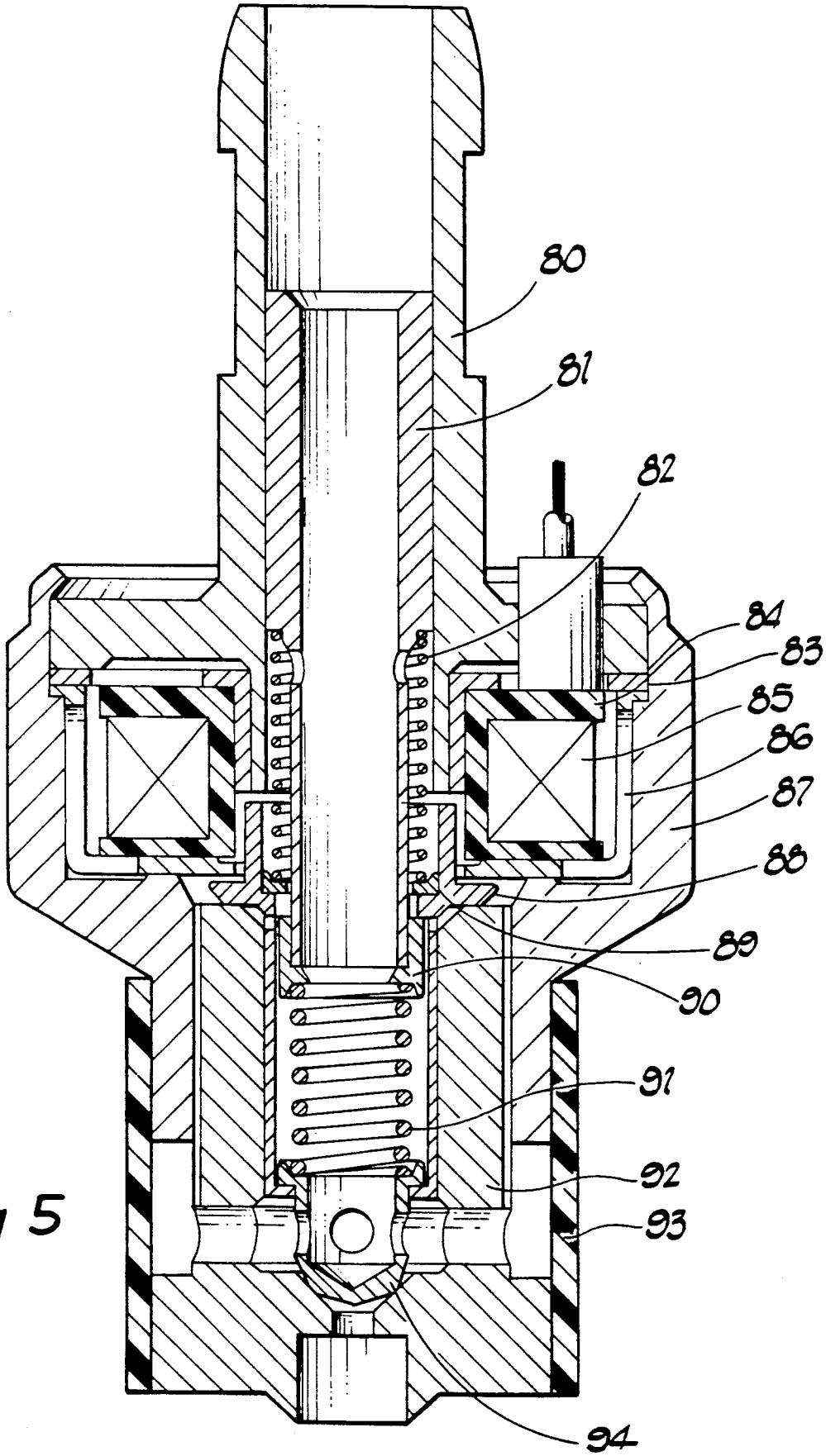
FIG. 5 is an axial cross-sectional view of an injection valve assembly employing teachings of the invention and mostly suited for use as a relatively low pressure fuel injection valve assembly as for injection into the induction passage means of an associated internal combustion engine.

FIG. 5 shows a low-pressure injection valve for induction passage injection in Otto cycle engines. The magnetic circuit is composed largely of thin sheets whose wall thickness is about 0.5 mm. The core 83 is pressed onto a tubular extension of the cover 80, which consists of non-magnetizable material. Thereby an improvement of the mechanical stability and a satisfactory centering of the core is obtained. The yoke 86 is provided with large-area openings, to reduce the leakage field. The window cross-section of the electromagnet is approximately square and thus has the magnet-technologically most favorable form, at which the leakage field is further reduced. The armature and guide tube form one part 88. For further reduction of eddy currents and for pressure compensation the armature is slit lengthwise. The outer pole cross-section is much greater than the inner pole cross-section, to reduce the reluctance of the magnetic circuit. Owing to this, relatively few turns of the coil 85 are required to obtain a sufficiently high inductance of the electromagnet, whereby at a given winding cross-section the thermal load of the coil is reduced. On the outer side, the yoke and core lie one on the other and are firmly pressed by the cover 80 into the collar of the housing 87, which likewise consists of non-magnetizable material.

The injection valve has a hat or cup shaped valve member 94 with relatively large diameter. The large diameter permits a form favorable in terms of flow with a large valve seat diameter, which requires only a small valve stroke even at high fuel flow. The valve member 94 is mounted in the guide tube of the armature with little radial play, to obtain self-centering. The valve member 94 has several radial bores of large diameter in order to obtain a fuel flow with little throttling.

The collar of the armature rests on the nozzle body 92 by a large area, to achieve a hydraulic damping of the armature movement during return of the armature. To prevent hydraulic sticking, the abutment point of the nozzle body is ground in radial direction. Further pressure compensation is obtained by radial bores in the guide tube. With the armature dropped or seated, there is little axial play between armature and valve member 94, to permit a pre-stroke of the armature. The armature is reset by the spring 82, the valve member 94 by the much stronger spring 91. Spring 91 engages at the top side of the valve member 94, so as not to hinder the fuel flow. Owing to this, however, radial disturbing forces may occur in case of eccentric engagement. The disturbing radial forces can be diminished by disposing the spring inside the valve member 94.

Adjusting the armature pre-stroke is done by pairing different armatures or valve members. Adjusting the opening stroke and hence the stationary fuel flow is done by correspondingly deep insertion of the valve member 94 into the housing 87. Adjustment of the end spring force and hence of the non-stationary fuel component of the injected quantity occurs by displacement of the adjusting tube 81. Spring 91 has a steep spring characteristic and spring 82 a spring characteristic with little inclination, so that the adjustment of the spring force is brought about almost exclusively through the spring 91, the initial spring force changing little at the beginning of the armature stroke.

The injection valve has a very large inflow cross-section with low flow velocities of the fuel. Because of the low inflow velocity of the fuel, much smaller hydrodynamic pressure oscillations as compared with the usual injection valves with higher inflow speed occur during the operation of the valve. Furthermore the oscillations are eliminated almost completely by a damping space arranged around the nozzle body in the immediate vicinity of the valve. The damping effect is obtained by the elasticity of the hose 93 arranged around the damping space, which hose serves at the same time as seal between housing and nozzle body and as heat insulation of the valve in the suction pipe of the engine. Any forming vapor bubbles can escape upward through axial grooves in the nozzle body. Vapor bubbles collecting in the top part of the injection valve are removed through radial bores in the adjusting tube 81 by the vacuum effect of the flowing fuel.

Another possibility of damping the hydrodynamic oscillations consists in providing the damping space with a rigid wall and designing it as a cavity resonator, called also "Helmholtz resonator". A cavity resonator is an enclosure with one or more openings which has a characteristic natural frequency depending on the dimensional layout. The natural frequency of the cavity resonator is tuned to the strongest oscillation occurring when the valve is in operation, which can thereby be eliminated to a large extent. The only condition for the functionality of the cavity resonator is that all cavity dimensions must be smaller than one quarter wavelength of the corresponding resonant frequency. For the removal of vapor bubbles there are furthermore required in the top part drain bores or as already shown drain grooves, the cross-section of which, however, must be so small that the functionality of the cavity resonator is not impaired. The dimensional layout of the cavity resonator can be read from pertinent trade literature.

FIG. 6 shows the magnetic force and the mechanical counter-force of the injection valve according to FIG. 5 as a function of the path S. The armature movement starts after the magnetic force exceeds the force of the armature reset spring 82, $F_1$. After traveling the path $S_1$, the armature comes in contact with the valve member, which is under the force of the reset spring 91 and the hydraulic forces. Thus there results a strong rise of the mechanical counter-force, which can exceed the magnetic force. With increasing pressure compensation under the valve seat surface of the valve member the mechanical counter-force decreases again, so that toward the end of the pull-up movement an excess of magnetic force is available again. As has been repeatedly described before, the mass of the valve member is again selected so that the subsequent chatter due to counter-directional collision of armature and valve member quickly ceases. The mechanical end force should be more than one half the saturation induction force, to achieve a rapid reset movement with little reset delay. The chatter of the valve member toward the end of the reset process quickly ceases because of the comparatively high reset spring force acting on the valve obturator at only low closing speed.

In the following drawings the utilization of the measures according to the invention is explained for injection valves known in their basic features.

Figure 7:
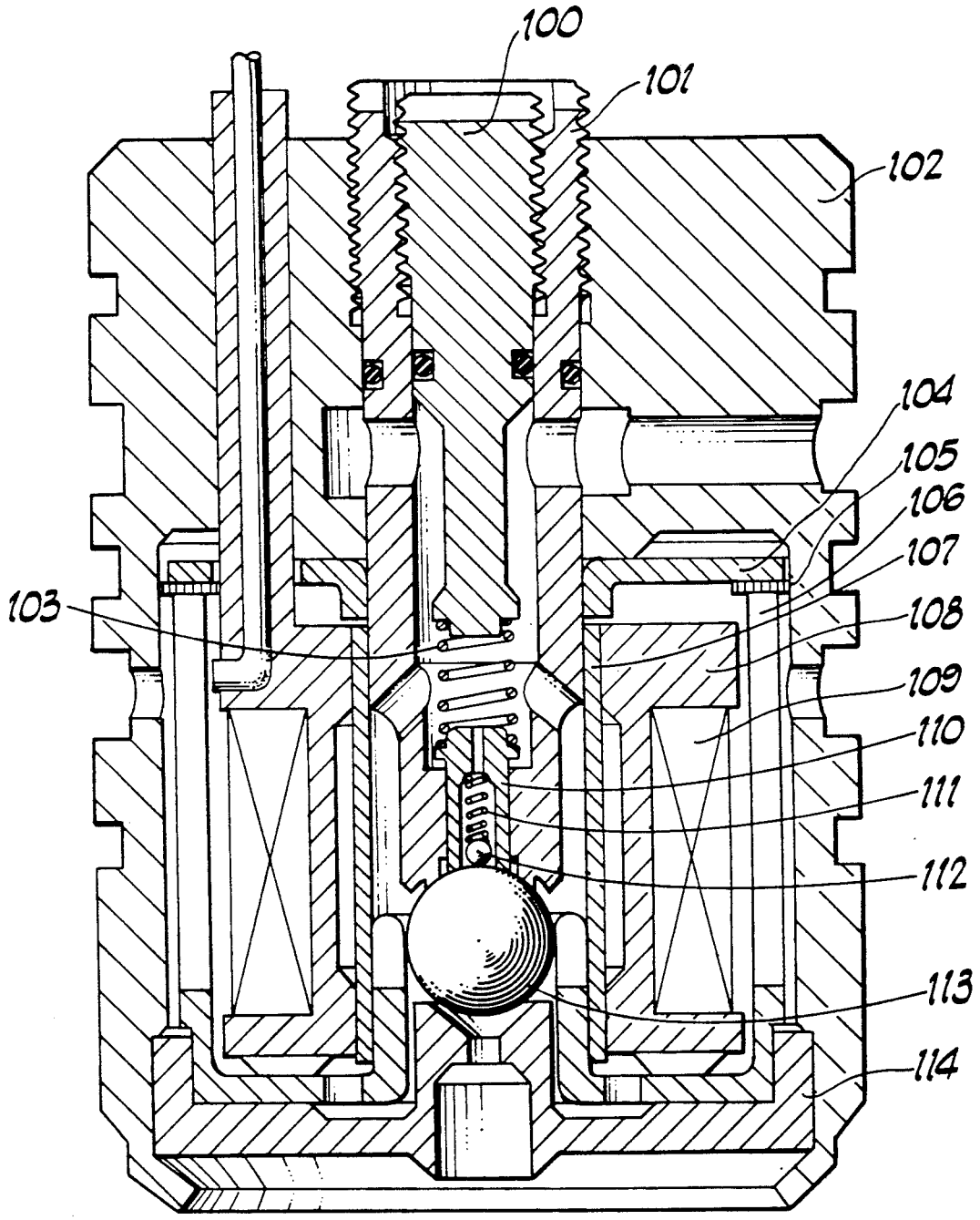
FIG. 7 is an axial cross-sectional view of another embodiment of injection valve assembly employing teachings of the invention.

FIG. 7 shows an electromagnetic injection valve with spherical armature, the magnetic circuit of which is composed of thin sheets or laminations. The jacket 106 of the magnetic circuit consists of several thin-walled fingers, to obtain large-area openings.

The armature 113 is guided by the jacket sheetmetal with little play in radial direction. The low leakage field magnetic circuit permits the use of small armatures with small armature mass, without the electromagnetic efficiency being thereby reduced very much. A thin plastic disk 105 of non-magnetizable material is inserted between the upper yoke plate and the jacket, to obtain a residual air gap. The upper yoke plate 104 is slipped onto the core 101. Inside the coil former 108 an elastic hose 107 of plastic is fastened by adhesive or welding, so that a cavity is formed between hose and coil. This arrangement serves to damp the hydrodynamic oscillations. The supplementary mass 110 is arranged inside the armature. The protrusion of the supplementary mass is taken so that with the aid of the strong spring 103 and of the weak spring 111 a suddenly changing force characteristic results. To reduce the reluctance, the pole of the core 101 is adapted to the spherical form of the armature, and is provided with a narrow collar to prevent hydraulic sticking. The collar is only a few 1/100 mm high, to permit a rapid pressure compensation under the pole area. The injection valve is flushed with fresh fuel to prevent vapor bubble formation.

To reduce chatter and to reduce the mechanical load of the valve seat, the nozzle body 114 is made thin-walled. The natural frequency of the nozzle body is again tuned so that the chatter of the armature 113 due to counter-directional movement quickly ceases. The plane of the separating joint of the housing is arranged close to the pole, to avoid centering problems. The armature stroke can be adjusted by rotation of the core, which is provided with a screw system; the mechanical end force, by rotation of the adjusting screw 100.

Figure 8:
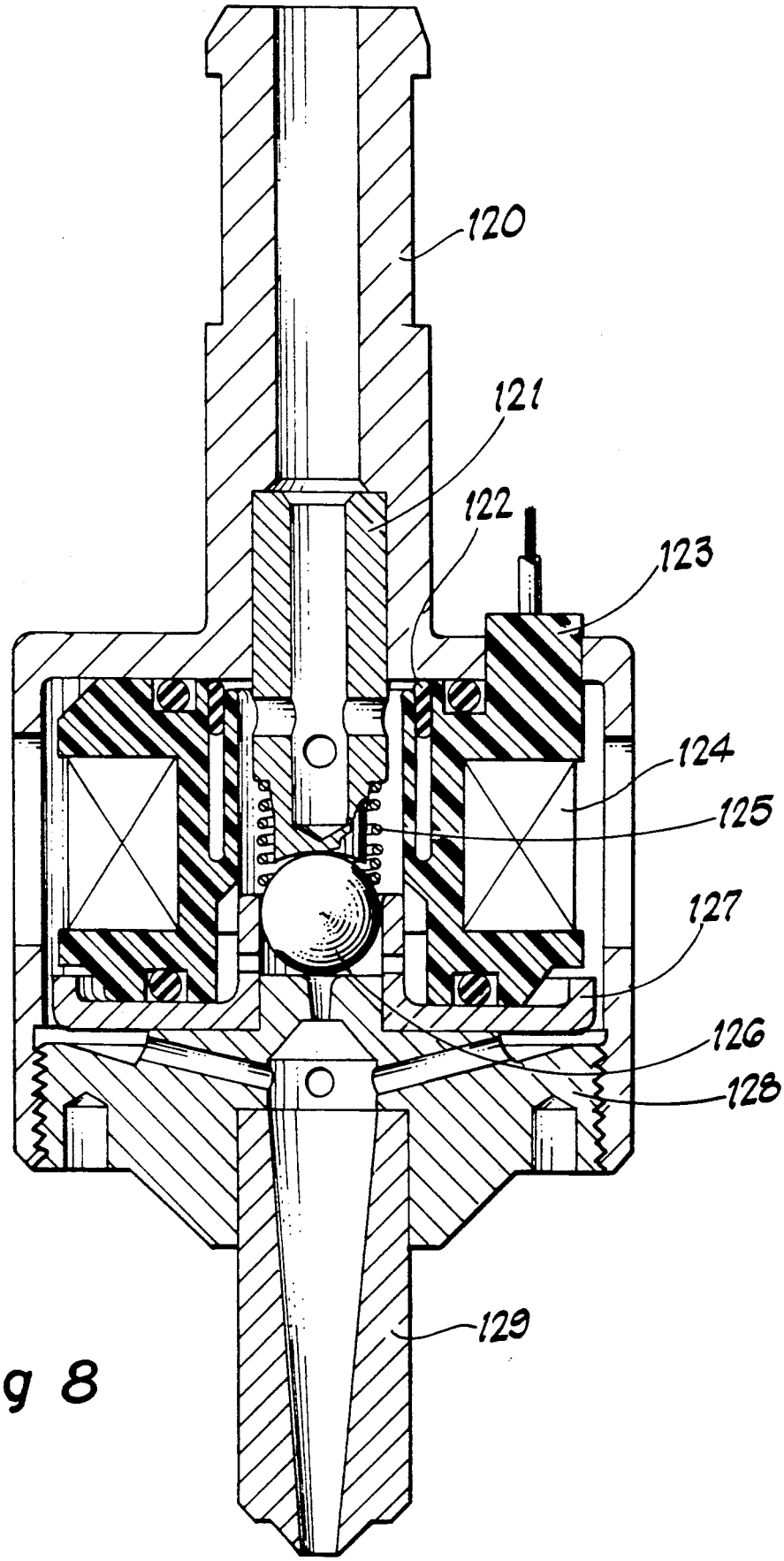
FIG. 8 is an axial cross-sectional view of yet another embodiment of injection valve assembly employing teachings of the invention.

FIG. 8 shows an electromagnetic injection valve with spherical armature and atomization device. The magnetic circuit consists of the housing 120, the core 121, which is pressed into the housing, the yoke plate 127, and the spherical armature 126. The armature is guided in the yoke plate with little radial play, to obtain reproducible setting movements. The yoke plate 127 is firmly joined to the nozzle body 128, which consists of non-magnetizable material, for example by adhesive bonding, pressing, or soldering. At the same time, the yoke plate of the nozzle body is centered by a collar, to bring about forcibly a centered position of the armature. For the damping of hydrodynamic oscillations the coil former 123 has an inner cavity, closed at the top by a seal ring 122 of non-magnetizable, non-conductive material The seal ring is fastened by gluing or welding. The cavity may also be produced, for example, by blowing or similar methods directly in the manufacture of the coil former.

The pole of the core is spherical, the radius of the pole being a few 1/100 mm larger than that of the spherical armature. Hence the gap cross-section widens from the inside out, so that hydraulic sticking is prevented and effective damping of the armature movement toward the end of the pull-up process is achieved. Because of the different radii, furthermore, slight centering inaccuracies of the core are compensated. Fuel inflow to the valve seat occurs almost exclusively through fine holes in the yoke plate 127. Depending on the flow velocity of the fuel, a perceptible throttling takes place in these holes, so that with the valve fully open a considerable vacuum is created. This vacuum produces a flow-dependent reset force. Already at little throttling, depending on the diameter ratio of valve seat and armature, a considerable mechanical resetting force is produced which, at a ball diameter sufficiently large in proportion to the seat diameter, has a steep ascent with increasing valve opening. The force response is well reproducible even at relatively inferior manufacturing precision of the inflow ports, so that as a rule a separate adjustment of the resetting force can be dispensed with. Because of the steep slope of the force characteristic a high end force is obtained, in a dynamically favorable manner, resulting in short reset processes. The throttling can be effected also through radial slots in the yoke plate, which slots may be arranged obliquely to produce angular momentum of the fuel. Of course, to make such slots with the required precision is more expensive than to make simple bores. Furthermore, such slots reduce the mechanical strength of the yoke plate and the accuracy with which the armature is guided.

The chatter occurring toward the end of the pull-up process is suppressed to a large extent by hydraulic damping in the impact gap. In comparison with the mechanical end force, the force of the reset spring 125 is small and serves only to secure a reliable seal of the valve also during the standstill phases of the engine.

The pole cross-section of the core 121 is greatly enlarged relative to the rest of the core cross-section, so as to achieve despite a large pole cross-section at small wall thickness of the core a low saturation magnetic force which only slightly exceeds the mechanical end force. By this measure the inductance of the coil is increased at equal number of turns and thereby the thermal load is reduced. It is possible to use a very simple actuating circuit without holding current reduction. The then always necessary current limitation occurs through an external series resistance.

To obtain a short reset delay, a residual air gap is always necessary for simple actuating circuits. The residual air gap is located between yoke plate 127 and housing 120. This residual air gap at the same time lets the atomization air pass. The atomization air is taken from a separate atomization air filter not shown, which is fitted directly onto the valve housing. The atomization air is conducted through the large area housing openings, serves at the same time for coil cooling, and subsequently passes through radial bores, which for creation of angular momentum may also have a tangential component, into the mixing zone or chamber below the nozzle body 128. The intimate mixing of fuel and atomization air occurs in the mixing tube 129. The mixing tube tapers in flow direction to improve the atomization at subsonic speeds of the atomization air. The atomization of the fuel is further supported by a sharp breakoff edge at the end of the mixing tube.

The valve stroke can be adjusted by rotation of the nozzle body. The position of the nozzle body is fixed, after completed calibration, preferably by pinning the housing and nozzle body together.

Figure 9:
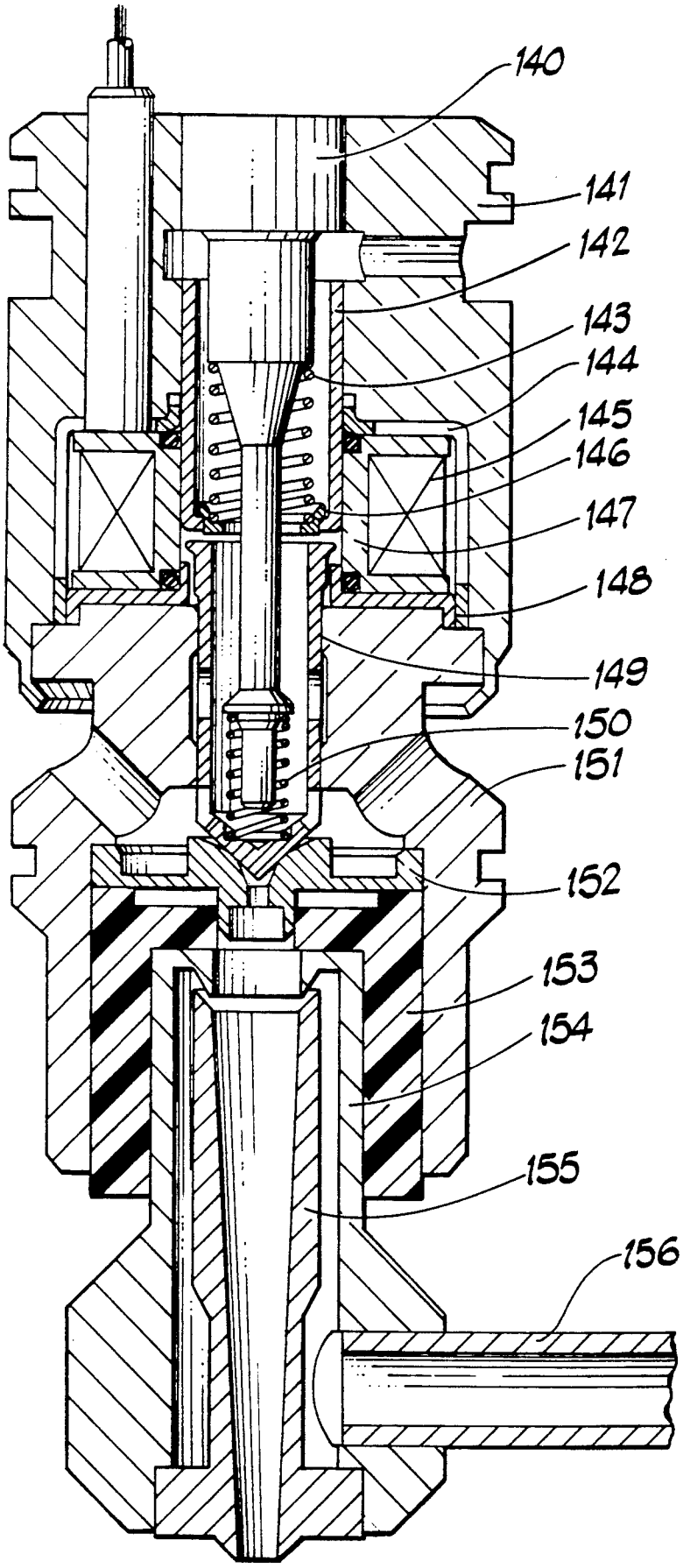
FIG. 9 is an axial cross-sectional view of still another embodiment of injection valve assembly employing teachings of the invention and wherein hot air atomization is used.

FIG. 9 shows an electromagnetic injection valve with hot air atomization. The thin-walled core 142 of the magnetic circuit is pressed into a housing 141 of non-magnetizable material. The jacket 144 of the magnetic circuit is provided with large-area openings and is pushed over the outer flange of the lower yoke plate 148. The supplementary mass 146 lies on a collar in the core 142. The supplementary mass is under the action of the spring 143, so that in joint action with the reset spring 150 a suddenly changing force characteristic results. The armature 149 is made extremely thin-walled and has a large inside diameter, to obtain reduced fuel throttling at low eddy current losses. The armature has a collar, which brings about a substantial improvement of the mechanical stability. Furthermore, the collar is disposed between the lower yoke plate 148 and the core 142, to obtain a compact construction of the magnetic circuit and a partial magnetic shielding of the working air gap, whereby the leakage field is further reduced. The armature, guide tube and valve member form one part, the wall thickness of the magnetic flux portion being only about 0.5 mm, that of the guide tube only about 0.2 mm. The result is a small armature mass of less than one gram at minimum electrodynamic losses, permitting very rapid setting processes at low electric energy consumption. The diameter of the armature is preferably 5–8 mm. The large armature diameter permits valve seats favorable in terms of flow with large diameter, so that high rates of fuel flow are possible at a small armature stroke. The pole surface of the armature is provided with radial grooves, to allow pressure compensation with the armature pulled up. The abutting surface of the armature or of the core is ground in radial direction to prevent hydraulic sticking. Bores of large diameter at the lower end of the armature and in the region of the suspension permit fuel passage with little throttling and pressure compensation.

The armature 149 is mounted in the housing bottom 151 in an upper and a lower section. The short length of the contact points of the suspension prevents friction. Pressed into the housing bottom is the plate-shaped nozzle body 152. The nozzle bottom has a low natural frequency. Machining of the nozzle body and of the bearing hole can be done in one clamping arrangement.

Adjusting the armature stroke is done by displacing the core 142. Thereafter the adjusting stud 140 is pressed into the housing 141, thereby adjusting the mechanical end force. As the core and adjusting stud have the same diameter a particularly simple production results.

To remove heat, the injection valve is continuously flushed with fresh fuel. Through several large bores, which to create fuel twist may also have a tangential component, the fuel passes to the valve seat, and thence through the armature into the housing. The fuel is let out again between the core and adjusting stud, so that radial perforation of these parts is not necessary.

The atomization device is pressed into the housing bottom. Heat insulation takes place through the insulating jacket 153, which consists of a material of low thermal conductivity. The atomization device consists of a mixing tube support 154 and the mixing tube 155. The mixing tube is provided with an upper collar and is pressed into the mixing tube support by this collar. The hot atomization air is conducted through the connecting piece 156 into the mixing tube support. The hot atomization air embraces the mixing tube and is conducted in counter-current to the direction of the atomized fuel to a ring nozzle on the outer side of the mixing tube. This causes the mixing tube to be intensively heated, the fuel condensation on the inner wall of the mixing tube being partially evaporated. Near its exit the mixing tube has oblique guide pieces which center the mixing tube and impart a twist to the atomization air. The hot atomization air issuing from the ring nozzle forms a potential whirl, which concentrically embraces the fuel jet. The fuel is sprayed in co-directional flow into the center of the potential whirl, in which a reduced pressure prevails, owing to which a greater pressure gradient becomes utilizable for the acceleration of the fuel drops. At overcritical pressure ratio between the pressure of the atomization air and the pressure in the suction pipe of the engine, compression shocks occur, which further improve the atomization.

Lastly some indications about the design of the fuel pump and about the electric actuation will be given.

For the creation of the system pressure fuel pumps are required. At low fuel pressure, a plurality of known pumps are suitable for this purpose. The pressure regulation can be effected in known manner simply by blowing off the excess fuel. Special problems arise, however, with pumps for the injection valve here proposed at pressures of about 1000 bar. Because of the high pressure, only a piston pump enters into consideration. The required drive power of this pump is very high, so that to reduce the drive power the volumetric flow should not be higher than necessary for the particular point on the engine characteristic. The pump plunger may be driven, for example, by an adjustable eccentric. The power requirement of such eccentrics shows a high hysteresis, so that direct adjustment by way of a pressurized piston and a lever transmission leads to unacceptable reactions on the system pressure. Besides, lever transmissions are a problem because of the high required transmission ratio and the extremely great lever forces. Therefore, indirect adjustment of the pump is desirable. Usually single-plunger pumps are sufficient, and an accumulator can be dispensed with, so that the accumulation function is obtained by the compressibility of the fuel and of the fuel lines.

Figure 10:
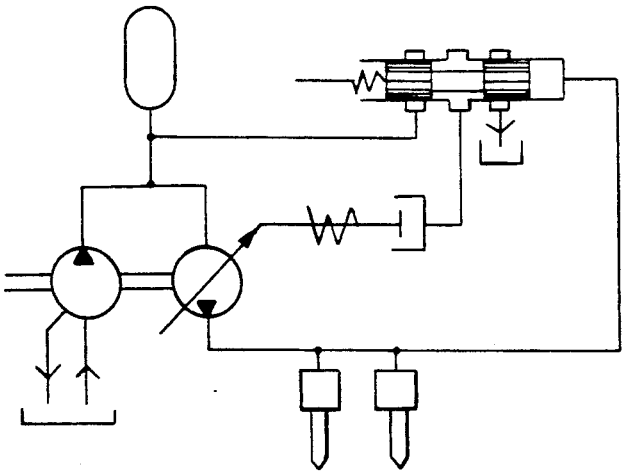
FIG. 10 is a schematic drawing of a particular fuel pumping and fuel pressure regulating system employable in practicing the invention.

FIG. 10 is a schematic diagram of such a fuel pump with indirect adjustment. By a preliminary pump the fuel is conveyed at approximately constant pressure to an accumulator, to an adjusting valve, and to a high-pressure pump. The pressure of the preliminary pump can be regulated in a simple manner by blowing off the excess fuel. The volumetric flow of the high-pressure pump is adjustable. Adjusting is done with a low-pressure cylinder. The pressure of the high-pressure pump acts on the adjusting valve. The pressure force on the high-pressure side of the adjusting valve is in equilibrium with the force of a resetting spring, so that there results a pressure-dependent excursion of the valve piston. Preferably cup spring packets are used as spring elements because of the high displacement force. By the excursion of the adjusting valve, the low-pressure cylinder is either evacuated or connected with the preliminary pump. For the creation of hysteresis, and to avoid oscillation problems, the adjusting valve may have a covering. The evacuation side of the adjusting valve is expediently arranged next to the high-pressure space, so that during malfunctions of the pump the adjusting valve serves at the same time as a safety valve.

In the proposed injection valve, where the kinetic energy of the armature is utilized to open the valve needle, the time span between the moment of connection of the exciting current and start of movement of the valve needle is dependent in large measure on the magnitude of the exciting voltage. To avoid additional cost of electronics for taking voltage fluctuations into consideration, it is favorable to stabilize the exciting voltage electronically. As the voltage strength of the switching transistors is not utilized at the usual on-board voltage of 12 volts, and in order to reduce the current load, it is favorable to increase the actuating voltage beyond the usual value of 12 volts. The actuating voltage should preferably be 60–100 volts. To increase the voltage, an electronic voltage transformer is required, which normally always possesses a transducer. In electromagnets with low eddy current, the expenditure for components can be greatly reduced by dispensing with the transducer, the transducer function being taken over by the magnet coil. The stored field energy is discharged between the individual excitation phases via one or more diodes into a storage capacitor. The mode of operation of such a circuit is explained with reference to FIG. 11-A.

Figure 11A:
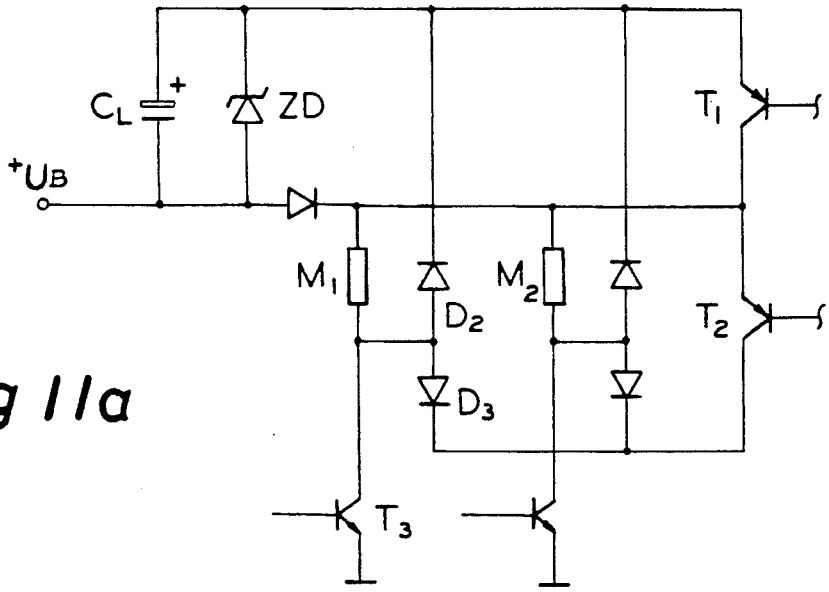
FIGS. 11-A and 11-B are respective electrical circuit diagrams illustrating electrical circuits employable for actuation of the various disclosed electromagnetic injection valve assemblies as well as others.
Figure 11B:
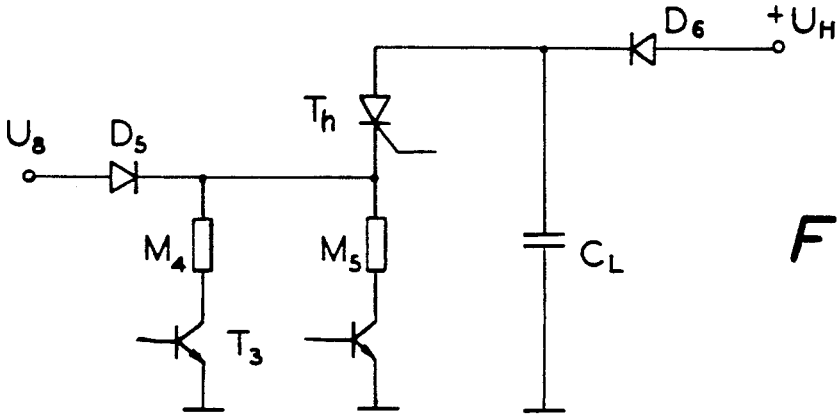

FIG. 11-A shows an actuating circuit for two electromagnetic fuel injection valves, marked $M_1$ and $M_2$. However, the circuit is suitable also for any number of injection valves, provided the individual actuation phases do not overlap. The circuit includes a charging capacitor $C_L$ of high capacitance, which upon disconnection of the individual electromagnets is charged by the action of the electromagnetic field energy to a voltage higher than the on-board power supply voltage. For voltage limitation in case of malfunctions of the circuit a Zener diode ZD is provided. The capacitor is connected in series with the on-board power supply voltage, so that upon excitation of the electromagnets the sum of on-board power supply voltage and charged voltage is effective. To facilitate comprehension of the circuit, the actuating logic circuit has not been shown. The mode of operation of the circuit is explained with reference to an actuation cycle of the electromagnet $M_1$. It is assumed that the charging capacitor is already charged to the full operating voltage.

At the start of excitation of the electromagnet $M_1$, transistors $T_1$ and $T_2$ are switched on jointly, so that the sum of on-board power supply voltage and capacitor charge voltage acts on the electromagnet. The diode $D_1$ prevents shortcircuit of the capacitor. Due to the high operating voltage, rapid excitation of the electromagnet is brought about with a relatively small current. This phase is referred to as rapid excitation phase. Toward the end of the rapid excitation phase, transistor $T_1$ is turned off. The then required low holding current is regulated by clocking the current flowing from the on-board power supply via diode $D_1$. During the break phases in the clocking of the transistor $T_3$, a slow or a fast drop of the exciting current can be achieved. A rapid drop results if transistor $T_2$ is turned off. At the same time energy is delivered to the charging capacitor via the diodes $D_1$ and $D_2$. When transistor $T_2$ is turned on, the electromagnet is shortcircuited via diode $D_3$ so that a very slow current drop results without energy supply to the charging capacitor. Hence it is readily possible to regulate the voltage of the charging capacitor by turning the transistor $T_2$ on or off preferably during the holding current phases. Furthermore the circuit permits great freedom in the selection of the exciting current response during and after the pull-up process.

In the case of short injection times and initialization of the circuit, it may happen that sufficient energy is not available for charging the capacitor. In such a case, the magnet coil is excited between or before the individual work cycles by clocking of the exciting current only to such an extent that the magnetic force does not yet exceed the mechanical counter-force. Sufficient energy can then be transmitted even at a low mechanical counter-force, because of the quadratic magnetic force buildup and because of the large air gap with the armature dropped. An additional energy transmission can be obtained also with pre-excitation of the electromagnet.

For the evaluation of the current response for actuation of the circuit, sensor resistors are also, of course, required which, however, have not been included in the drawing for the sake of greater clarity. To influence the injection pattern, adjustment of the charging voltage can be provided. In particular for low-pressure injection valves, this can be designed as an integrated circuit jointly with the triggering logic, so that because of the good utilization of the possible voltage strength of the output stage transistors external power transistors are not necessary. Furthermore, the circuit is also very safe in case of malfunctions, since under all actuating conditions a current limitation through the magnet coil is always obtained.

An additional stabilization of the pull-up process can be achieved by the magnetic field energy being coupled-in through a capacitor discharge. The capacitor discharge can occur in a semioscillation, but this requires expensive actuating circuits. Especially simple circuits result when, for the energy transmission, merely a quarter oscillation is utilized. Such a circuit is illustrated in FIG. 11-B. The circuit requires very little expenditure for the triggering logic and is suitable in particular for the actuation of high-pressure injection valves.

The circuit according to FIG. 11-B uses a capacitor $C_1$ with a relatively small capacitance. The stored energy of the capacitor is dependent linearly on the capacitance and quadratically on the charging voltage. The charging voltage is selected so that at capacitance values of preferably 2–10 microfarads a sufficient quantity of energy is stored. This requires relatively high charging voltages of about 100–300 volts, depending on the size of the injection valve. At a given required pull-up time and a given inductance of the electromagnet, the capacitance of the capacitor is selected so that the least possible energy consumption results.

From an external current source the capacitor is charged to the voltage $U_H$. In principle both so-called blocking and non-blocking oscillators are suitable as voltage source. In non-blocking oscillators the energy is transmitted during the flow phase of the transducer. It can be shown in the theory that with the charging of capacitors even at ideal efficiency of the oscillator efficiencies of 50% in the energy delivery to the capacitor cannot be exceeded because a considerable loss of energy occurs at the internal resistance of this current source. Blocking oscillators on the contrary, where the energy is drawn from the magnetic field of the transducer during the blocking phase, and also electromagnets deliver pulses of constant energy which are independent of the charging voltage and therefore permit low-loss charging of the capacitor. In the present case, therefore, only voltage transformers on the principle of the blocking oscillator should be used as current source. The maximum charging voltage of the capacitor is limited electronically by cutting off the energy supply. Control of the charging voltage to influence the injection pattern is desirable.

The circuit according to FIG. 11-B can be operated with any desired number of electromagnets provided their actuation phases do not overlap. The mode of operation will be explained with reference to actuation of the electromagnet $M_4$. The capacitor discharge is triggered by simultaneous switching through thyristor Th and of transistor $T_3$. The magnet coil and capacitor then form a resonant circuit. Disposed in the resonant circuit is thyristor Th which, after reaching the current maximum or respectively during voltage zero crossing, is commutated and thereby prevents current redelivery of the magnet coil and negative charge of the charging capacitor. Furthermore, by isolating the charging capacitor a renewed charge, even during the work cycle of the electromagnet, is made possible so that a large number of electromagnetic injection valves with blocking oscillators of low power can be operated.

In the case of small blocking oscillators the energy supply need usually not be interrupted, as the latter is not sufficient to prevent commutation. Therefore a single voltage regulation of the maximum charging voltage is required, which operates independently of the individual injection phases. However, the thyristor may be replaced by a diode, but then only a much shorter time is available for the charging of the capacitor between injections, so that a blocking oscillator of greater maximum power is required. Then, however, the blocking oscillator can be made use of also to generate the holding current, if desired.

The diode $D_5$ prevents shortcircuit with the on-board power supply. After the blocking of the thyristor, the further current supply occurs from the on-board power supply with the volta $U_B$. In the circuit here involved, direct supply from the on-board power supply results in a slow exponential current drop, but for the low eddy-current injection valves of the invention having a high resetting force this does not lead to an unacceptable reset delay at short injection times. At low coil resistances the arrangement of a resistor for holding current limitation in series with diode $D_5$ or better still the use of a current regulating circuit is required. On the other hand, for lower requirements as to the dynamics and at low resetting forces, the diode $D_5$ may be connected directly to ground instead of to the on-board power supply voltage, so that then the holding current is taken from the magnetic field of the electromagnet. For high requirements as to the dynamics, however, an additional stabilization of the holding current or of the supply voltage is always desirable. To obtain a rapid field reduction after the rapid excitation phase, the transistor is then briefly turned off after the end of the pull-up process. For limiting the cutoff voltage peak, additional well known protective devices are, of course, necessary, which have not been represented, however. A holding current limitation can be achieved also by clocking. Such known circuits can readily be combined with the circuit according to the invention, so that further description is unnecessary. When clocking the holding current, of course, the reproducibility of the injection process is somewhat impaired, because the electro-dynamic conditions will differ in the resetting process depending on whether at the moment of disconnection the holding current was rising or falling.

In closing it should be pointed out expressly that the measures according to the invention are not limited to their application in the electromagnetic injection valves here shown. The teachings of the invention can be employed in all cases where very rapid, well reproducible setting movements with little energy expenditure are required. In addition, the presented injection valves can be employed in a slightly modified form also as rapid valves in general hydraulics. The magnetic circuits may be equipped with enlarged pole surfaces and flanging of the poles.

Furthermore the components of the presented electromagnetic injection valves may be produced in a manner different from that proposed; for example, manufacture of the magnet components of solid material by sintering, deep drawing, rolling or chip removal is possible.

It is possible to use hydraulic resetting in nearly all known low-pressure injection valves with radially guided armature. All that is necessary to this end is to provide a corresponding throttling of the fuel flow between the top and underside of the moved parts, so as to obtain a flow-dependent setting force.

Although only selected preferred embodiments and modifications of the invention have been disclosed and described it is apparent that other embodiments and modifications of the invention are possible within the scope of the appended claims.

What is claimed is:

1. In combination with an electromagnetic duty cycle type liquid fuel metering valving assembly having liquid fuel metering port means and valving means cyclically moved to opened and closed positions with respect to said liquid fuel metering port means to thereby correspondingly intermittently permit and terminate the flow of said liquid fuel through said liquid fuel metering port means as to thereby control the rate of metered liquid fuel discharged through and from said liquid fuel metering port means to an associated combustion engine, first passage means communicating at one end with said liquid fuel metering port means downstream thereof and at an other end communicating with said engine, second passage means for supplying fuel atomizing air to said first passage means for creating from said air and said metered liquid fuel a fuel-air mixture, wherein at least a portion of said first passage means is tapered as to thereby enhance the mixing of said fuel-air mixture flowing therethrough and toward said engine, wherein said first passage means is comprised of a body portion forming a part of said duty cycle type liquid fuel metering valving assembly and is further comprised of conduit means operatively connected to said body portion, wherein said tapered portion is formed in said conduit means, wherein said second passage means is so formed as to supply said atomizing air in a direction of flow which generally transversely intersects the direction of flow of said metered liquid fuel, wherein said first passage means comprises a chamber-like portion situated immediately downstream of said liquid fuel metering port means, and wherein said tapered portion is situated downstream of said chamber-like portion, wherein said second passage means communicates with said first passage means by communicating directly with said chamber-like portion, wherein said second passage means comprises a plurality of atomizing air directing and supplying passages.

2. In combination with an electromagnetic duty cycle type liquid fuel metering valving assembly having liquid fuel metering port means and valving means cyclically moved to opened and closed positions with respect to said liquid fuel metering port means to thereby correspondingly intermittently permit and terminate the flow of said liquid fuel through said liquid fuel metering port means as to thereby control the rate of metered liquid fuel discharged through and from said liquid fuel metering port means to an associated combustion engine, first passage means communicating at one end with said liquid fuel metering port means downstream thereof and at an other end communicating with said engine, second passage means for supplying fuel atomizing heated air to said first passage means for creating from said air and said metered liquid fuel a fuel-air mixture, said second passage means being effective to direct said heated air against an external surface of said first passage means in order to heat said first passage means and thereby enhance the expansion and intermixing of said fuel-air mixture flowing through said first passage means, wherein said first passage means comprises a generally tubular and axially elongated conduit member comprising outer surface means and inner surface means, wherein said second passage means directs said heated air to said outer surface means at an area relatively remote from said one end as to deliver the most heat to said conduit member at said area, and wherein said second passage means continues the flow of said heated air to an area at least near said one end for delivery to and flow against said inner surface means as part of said fuel-air mixture.

3. In combination with an electromagnetic duty cycle type liquid fuel metering valving assembly having liquid fuel metering port means and valving means cyclically moved to opened and closed positions with respect to said liquid fuel metering port means to thereby correspondingly intermittently permit and terminate the flow of said liquid fuel through said liquid fuel metering port means as to thereby control the rate of metered liquid fuel discharged through and from said liquid fuel metering port means to an associated combustion engine, first passage means communicating at one end with said liquid fuel metering port means downstream thereof and at an other end communicating with said engine, and second passage means generally circumscribing said first passage means and communicating with said first passage means, said second passage means being effective for supplying fuel atomizing air to said first passage means for creating fuel atomizing air metered liquid fuel a fuel-air mixture.

4. In combination with an electromagnetic duty cycle type liquid fuel metering valving assembly having liquid fuel metering port means and valving means cyclically moved to opened and closed positions with respect to said liquid fuel metering port means to thereby correspondingly intermittently permit and terminate the flow of said liquid fuel through said liquid fuel metering port means as to thereby control the rate of metered liquid fuel discharged through and from said liquid fuel metering port means to an associated combustion engine, first passage means communicating at one end with said liquid fuel metering port means downstream thereof and at an other end communicating with said engine, second passage means generally circumscribing said first passage means and communicating with said first passage means, said second passage means being effective for supplying fuel atomizing heated air to said first passage means for creating from said air and said metered liquid fuel a fuel-air mixture, said second passage means being effective to direct said heated air against an external surface of said first passage means in order to heat said first passage means and thereby enhance the expansion and intermixing of said fuel-air mixture flowing through said first passage means.

5. In combination with an electromagnetic duty cycle type liquid fuel metering valving assembly having liquid fuel metering port means and valving means cyclically moved to opened and closed positions with respect to said liquid fuel metering port means to thereby correspondingly intermittently permit and terminate the flow of said liquid fuel through said liquid fuel metering port means as to thereby control the rate of metered liquid fuel discharged through and from said liquid fuel metering port means to an associated combustion engine, first passage means communicating at one end with said liquid fuel metering port means downstream thereof and at an other end communicating with said engine, said first passage means being of generally tubular configuration and comprising inner surface means defining axially extending inner passage means and axially extending external surface means generally circumscribing said inner passage means, second passage means for supplying fuel atomizing heated air to said inner passage means for creating from said air and said metered liquid fuel a fuel-air mixture, said second passage means being effective to supply said heated air by first causing said heated air to flow against and along said external surface means of said first passage means in order to heat said first passage means and thereby enhance the expansion and intermixing of said fuel-air mixture flowing through said inner passage means.

6. The combination according to claim 2 wherein at least a portion of said inner surface means is of tapered decreasing flow area in the direction of flow of said fuel-air mixture.

7. The combination according to claim 2 wherein the cross-sectional thickness of said conduit member is of relatively reduced thickness in said area as to thereby be able to more rapidly transmit heat therethrough.

8. The combination according to claim 2 wherein said second passage means is a single flow passage.

9. The combination according to claim 7 wherein said relatively reduced cross-sectional thickness is formed by a reduction of material comprising said conduit member with said reduction occurring generally into said outer surface means and toward said inner surface means.

10. The combination according to claim 9 wherein said second passage means is a single flow passage.

11. The combination according to claim 7 wherein said relatively reduced cross-sectional thickness is attained by an annular recess formed into said outer surface of said conduit member.

12. The combination according to claim 11 wherein said second passage means is a single flow passage.

13. The combination according to claim 5 wherein at least a portion of said inner passage means is of tapered decreasing flow area in the direction of flow of said fuel-air mixture.

14. The combination according to claim 5 wherein said second passage means directs said heated air to said external surface means at an area remote from said one end.

15. The combination according to claim 14 wherein said first passage means comprises a conduit member, and wherein the cross-sectional thickness of said conduit member is of relatively reduced thickness in said area as to thereby be able to more rapidly transmit heat therethrough.

16. In combination according to claim 13 wherein said second passage means directs said heated air to said external surface means at an area remote from said one end.

17. The combination according to claim 3 wherein said first passage means comprises a first conduit member, wherein said second passage means comprises a second conduit member, wherein said first conduit member is supported as to be generally centrally of and generally within said second conduit member, and wherein said second passage means exists generally between said first and second conduit members and generally circumferentially about said first conduit member.

18. The combination according to claim 17 wherein said second conduit member comprises transverse wall means situated axially between said liquid fuel metering port means and said one end of said first passage means, and further comprising aperture means formed through said transverse wall means to complete communication between said liquid fuel metering port means and said one end of said first passage means.

19. The combination according to claim 18 wherein said one end of said first passage means also comprises a first end of said first conduit member, wherein said transverse wall means is axially spaced from said first end of said first conduit member, and wherein said second passage means supplies said air to said first passage means by flowing said air between said transverse wall means and said first end and into said first passage means.

20. The combination according to claim 4 wherein said first passage means comprises a first conduit member, wherein said second passage means comprises a second conduit member, wherein said first conduit member is supported as to be generally centrally of and generally within said second conduit member, and wherein said second passage means exists generally between said first and second conduit members and generally circumferentially about said first conduit member.

21. The combination according to claim 20 wherein said second conduit member comprises transverse wall means situated axially between said liquid fuel metering port means and said one end of said first passage means, and further comprising aperture means formed through said transverse wall means to complete communication between said liquid fuel metering port means and said one end of said first passage means.

22. The combination according to claim 21 wherein said one end of said first passage means also comprises a first end of said first conduit member, wherein said transverse wall means is axially spaced from said first end of said first conduit member, and wherein said second passage means supplies said heated air to said first passage means by flowing said heated air between said transverse wall means and said first end and into said first passage means.

* * * * *